US007763406B2

(12) United States Patent
Nukada et al.

(10) Patent No.: US 7,763,406 B2
(45) **Date of Patent: *Jul. 27, 2010**

(54) ELECTROPHOTOGRAPHIC PHOTORECEPTOR, PROCESS CARTIDGE AND ELECTROPHOTOGRAPHIC APPARATUS

(75) Inventors: Hidemi Nukada, Minamiashigara (JP); Hirofumi Nakamura, Minamiashigara (JP); Yu Qi, Oakville (CA); Nan-Xing Hu, Oakville (CA); Ah-Mee Hor, Mississauga (CA); Koji Bando, Minamiashigara (JP)

(73) Assignees: Fuji Xerox Co., Ltd., Tokyo (JP); Xerox Corporation, Norwalk, CT (US)

( * ) Notice: Subject to any disclaimer, the term of this patent is extended or adjusted under 35 U.S.C. 154(b) by 198 days.

This patent is subject to a terminal disclaimer.

(21) Appl. No.: 11/081,650

(22) Filed: Mar. 17, 2005

(65) Prior Publication Data

US 2006/0014091 A1 Jan. 19, 2006

(30) Foreign Application Priority Data

Jul. 16, 2004 (JP) ..... 2004-210749

(51) Int. Cl.
*G03G 5/047* (2006.01)
*G03G 5/14* (2006.01)

(52) U.S. Cl. ..... 430/59.4; 430/59.5; 430/60; 430/65; 399/159

(58) Field of Classification Search ..... 430/59.4, 430/59.5, 60, 65; 399/116, 159
See application file for complete search history.

(56) References Cited

U.S. PATENT DOCUMENTS

| | | | | |
|---|---|---|---|---|
| 4,264,695 | A | 4/1981 | Kozima et al. | |
| 4,265,990 | A | 5/1981 | Stolka et al. | |
| 4,298,697 | A | 11/1981 | Baczek et al. | |
| 4,338,390 | A | 7/1982 | Lu | |
| 4,560,635 | A | 12/1985 | Hoffend et al. | |
| 4,778,671 | A | 10/1988 | Wusirika | |
| 4,792,507 | A * | 12/1988 | Yoshihara et al. | 430/59.6 |
| 5,008,706 | A | 4/1991 | Ohmori et al. | |
| 5,102,757 | A | 4/1992 | Akasaki et al. | |
| 5,363,176 | A | 11/1994 | Ishihara et al. | |
| 5,430,526 | A * | 7/1995 | Ohkubo et al. | 399/159 |
| 5,446,011 | A | 8/1995 | Hayakawa et al. | |
| 5,486,440 | A | 1/1996 | Kashizaki et al. | |
| 5,795,690 | A | 8/1998 | Takegawa et al. | |
| 5,891,594 | A | 4/1999 | Yuh et al. | |
| 5,958,638 | A | 9/1999 | Katayama et al. | |
| 5,965,311 | A * | 10/1999 | Suzuki | 430/60 |
| 5,972,550 | A | 10/1999 | Tamura et al. | |
| 6,137,976 | A | 10/2000 | Itaya et al. | |
| 6,183,869 | B1 * | 2/2001 | Okuda et al. | 428/411.1 |
| 6,190,811 | B1 * | 2/2001 | Tanaka et al. | 430/78 |
| 6,277,535 | B1 | 8/2001 | Liu et al. | |
| 6,284,421 | B1 | 9/2001 | Matsuzaki et al. | |
| 6,453,139 | B2 | 9/2002 | Sasame et al. | |
| 6,455,222 | B1 | 9/2002 | Fukino et al. | |
| 6,623,655 | B1 | 9/2003 | Kappel et al. | |
| 6,773,857 | B2 | 8/2004 | Nakamura et al. | |
| 6,795,690 | B2 | 9/2004 | Weissman et al. | |
| 6,921,618 | B2 | 7/2005 | Hongo et al. | |
| 6,924,076 | B2 | 8/2005 | Saiki et al. | |
| 6,946,226 | B2 * | 9/2005 | Wu et al. | 430/64 |
| 7,153,574 | B2 * | 12/2006 | Qi et al. | 428/403 |
| 2002/0025179 | A1 | 2/2002 | Toyohara et al. | |
| 2003/0118927 | A1 * | 6/2003 | Nakamura et al. | 430/65 |
| 2004/0161684 | A1 * | 8/2004 | Wu et al. | 430/65 |
| 2005/0042533 | A1 * | 2/2005 | Wu et al. | 430/64 |
| 2005/0207788 | A1 | 9/2005 | Bandou et al. | |
| 2006/0013615 | A1 | 1/2006 | Nukada et al. | |
| 2006/0013616 | A1 | 1/2006 | Nukada et al. | |
| 2006/0014090 | A1 | 1/2006 | Shiino et al. | |
| 2006/0014091 | A1 | 1/2006 | Nukada et al. | |
| 2006/0014092 | A1 | 1/2006 | Nukada et al. | |
| 2006/0029872 | A1 * | 2/2006 | Qi et al. | 430/58.8 |

FOREIGN PATENT DOCUMENTS

| | | |
|---|---|---|
| CN | 1105128 | 7/1995 |
| CN | 1207635 C | 6/2005 |
| EP | 0 810 481 A2 | 12/1997 |
| EP | 1286225 | 11/2005 |
| JP | A 60-218655 | 11/1985 |
| JP | A 61-80158 | 4/1986 |
| JP | B2 61-35551 | 8/1986 |
| JP | A 61-204640 | 9/1986 |
| JP | A 63-142362 | 6/1988 |

(Continued)

OTHER PUBLICATIONS

USPTO English-language translation of JP 2004-126069 (pub. Apr. 2004).*

(Continued)

*Primary Examiner*—Janis L Dote
(74) *Attorney, Agent, or Firm*—Oliff & Berridge, PLC

(57) ABSTRACT

An electrophotographic photoreceptor has at least an undercoat layer and a photosensitive layer formed on a conductive substrate, wherein the undercoat layer contains metal oxide fine particles and an electron acceptor compound having a group reactive with the metal oxide fine particles. A process cartridge and an electrophotographic apparatus use the electrophotographic photoreceptor.

16 Claims, 5 Drawing Sheets

FOREIGN PATENT DOCUMENTS

| | | |
|---|---|---|
| JP | A-07-175249 | 7/1995 |
| JP | A-08-044097 | 2/1996 |
| JP | A-09-197701 | 7/1997 |
| JP | A-9-218592 | 8/1997 |
| JP | A-11-95472 | 4/1999 |
| JP | A-2000-321805 | 11/2000 |
| JP | A 2003-241511 | 8/2003 |
| JP | A-2004-93792 | 3/2004 |
| JP | A 2004-126069 | 4/2004 |

OTHER PUBLICATIONS

American Chemical Society File Registry No. 81-54-9, entered STN on Nov. 16, 1984, Copyright 2010 ACS on STN.*

American Chemical Society File Registry No. 602-64-2, entered STN on Nov. 16, 1984, Copyright 2010 ACS on STN.*

American Chemical Society File Registry No. 6486-93-7, entered STN on Nov. 16, 1984, Copyright 2010 ACS on STN.*

American Chemical Society File Registry No. 82-29-1, entered STN on Nov. 16, 1984, Copyright 2010 ACS on STN.*

American Chemical Society File Registry No. 6374-82-9, entered STN on Nov. 16, 1984, Copyright 2010 ACS on STN.*

Varcum 29159 Data Sheet, Durez Corp. (Jul. 13, 2005).

ESP@cenet abstract describing EP 1286225, European equivalent of CN 1403879 (pub. Mar. 19, 2003).

Grant, R., et. al, ed., Grant & Hackh's Chemical Dictionary, Fifth edition, McGraw-Hill Co., NY (1987), pp. 268 and 269.

Notification of Reasons for Rejection for Japanese Patent Application Publication No. 2004-210749, Sep. 8, 2009 (with English-language translation).

* cited by examiner

ELECTROPHOTOGRAPHIC PHOTORECEPTOR, PROCESS CARTIDGE AND ELECTROPHOTOGRAPHIC APPARATUS

CROSS-REFERENCE TO RELATED APPLICATION

This application claims priority under 35 USC 119 from Japanese Patent Application No. 2004-210749, the disclosure of which is incorporated by reference herein.

BACKGROUND OF THE INVENTION

1. Field of the Invention

The present invention relates to an electrophotographic photoreceptor for use in image forming by an electrophotographic process, and a process cartridge and an electrophotographic apparatus using the electrophotographic photoreceptor.

2. Description of the Related Art

Electrophotographic processes, which allow high-speed and high-quality printing, have been used in various electrophotographic apparatuses such as copying machines, laser beam printers, and the like.

Mainstream electrophotographic photoreceptors used in electrophotographic apparatuses use an organic photoconductive material, and the performance of the photoreceptors has been improved as more electrophotographic apparatuses adopt a functionally separated layered electrophotographic photoreceptor that has a charge-transporting material and a charge-generating material formed in separate layers.

Currently, in the case of layered electrophotographic photoreceptors, an undercoat layer is first formed on an aluminum substrate and a photosensitive layer consisting of a charge-generating layer and a charge-transporting layer is formed thereon.

The operational and environmental stability of electrophotographic photoreceptors during repeated use largely depend not only on the charge-generating layers and charge-transporting layers but also on the undercoat layer, and there exists a need for an undercoat layer that does not accumulate electric charge through repeated use.

The undercoat layer also plays a significant role in preventing image quality defects, and thus is an important functional layer for suppression of defects and stains on a substrate or image quality defects derived from defects and surface irregularity of upper layers such as the charge-generating layer.

In particular, in electrostatic charging devices using a contact charging process, which generate a smaller amount of ozone and are thus recently in electrophotographic apparatuses enjoying wider use in place of corotron-charging devices, electrical pinholes are often generated by a locally high electric field applied onto locally degraded areas of the electrophotographic photoreceptor during contact charging, leading to occasional image quality defects.

The pinhole leak is not only caused by the defects of coated films on an electrophotographic photoreceptor itself as described above, but also by conductive foreign substances generated in an electrophotographic apparatus, which come into contact with or penetrate into the electrophotographic photoreceptor, forming conductive paths between the contact-type electrostatic charging device and the electrophotographic photoreceptor substrate. In some special cases, foreign substances derived from other members of the electrophotographic apparatus and dust brought into the electrophotographic apparatus generate leak points from the contact-type electrostatic charging device, by sticking into the electrophotographic photoreceptor.

As a method to overcome the above problems, a layer containing conductive fine powders has been formed on the substrate to conceal such defects and stabilize the electrical properties of the substrate by thickening the undercoat layer.

An example thereof is a method for forming a conductive layer containing dispersed conductive powders on an aluminum substrate and additionally forming an undercoat layer over the conductive layer. In such a case, the conductive layer conceals the defects and also adjusts the resistance of the substrate, while the undercoat layer demonstrates a blocking (charge injection-controlling) function.

Another example is a method of applying a conductive powder dispersion layer having both a blocking (charge injection-controlling) capability and a resistance-adjusting capability on a substrate and using it as an undercoat layer having the functions both of a blocking (charge injection-controlling) layer and a resistance-adjusting layer.

The latter kind of undercoat layer, which permits elimination of one layer from the layers in the former kind of undercoat layer, allows simplification of the manufacturing process for the electrophotographic photoreceptor and cost reduction.

However, the latter kind of undercoat layer, which demands both the resistance-adjusting and charge injection-controlling functions in a single undercoat layer, imposes a significant restriction on material design.

In addition, for leak prevention, a thicker undercoat layer is more effective and thus a film having a thickness of 10 μm or more is demanded; but if the resistance of a thick film is reduced for obtaining favorable electrical properties, it tends to have a deteriorated charge-blocking property and an increase in background fog as an image quality defect.

The thickness of the latter kind of undercoat layer so far commercialized, for example, undercoat layers containing conductive titanium oxide powders, remains approximately in the range of one to several μm; and thus, there has existed no thickened undercoat layers containing conventional materials that satisfy all the requirements for electrophotographic photoreceptors such as improved leakage resistance, stabilized electrical properties, and low background fog.

In particular, recent increased recognition of environmental issues has urged prompt development of longer-life electrophotographic photoreceptors, and under these circumstances, stabilization of electrical properties and image quality during long-term repeated use is essential.

Alternatively, methods of adding additives such as an electron-accepting material and an electron-transporting material to the undercoat layer has been proposed (e.g., Japanese Patent Application Laid-Open (JP-A) Nos, 7-175249, 8-44097, and 9-197701).

However, even with these methods, it is impossible to obtain a thickened undercoat layer that satisfies all the requirements for electrophotographic photoreceptors such as the improved leakage resistance, stabilized electrical properties, and low background fog.

The present invention has been devised in view of these problems, and provides an electrophotographic photoreceptor superior in electrical properties that has a smaller fluctuation in electrical properties and generates fewer image quality defects such as pinhole leaks and the like during repeated use, and a process cartridge and an electrophotographic apparatus using the electrophotographic photoreceptor.

SUMMARY OF THE INVENTION

A first aspect of the present invention provides an electrophotographic photoreceptor having at least an undercoat layer and a photosensitive layer formed on a conductive substrate, wherein the undercoat layer contains metal oxide fine particles and an electron acceptor compound having a group reactive with the metal oxide fine particles.

A second aspect of the invention provides a process cartridge equipped with an electrophotographic photoreceptor having at least an undercoat layer and a photosensitive layer formed on a conductive substrate, wherein the undercoat layer contains metal oxide fine particles and an electron acceptor compound having a group reactive with the metal oxide fine particles and at least one device selected from an electrostatic charging device, a developing device, a cleaning device, and a static charge eliminator, that is detachable from the main electrophotographic apparatus.

A third aspect of the invention provides an electrophotographic apparatus equipped with an electrophotographic photoreceptor having at least an undercoat layer and a photosensitive layer formed on a conductive substrate, wherein the undercoat layer contains metal oxide fine particles and an electron acceptor compound having a group reactive with the metal oxide fine particles.

BRIEF DESCRIPTION OF THE DRAWINGS

Preferred embodiments of the present invention will be described in detail based on the following figures, wherein.

DETAILED DESCRIPTION OF THE INVENTION

Figure 1:
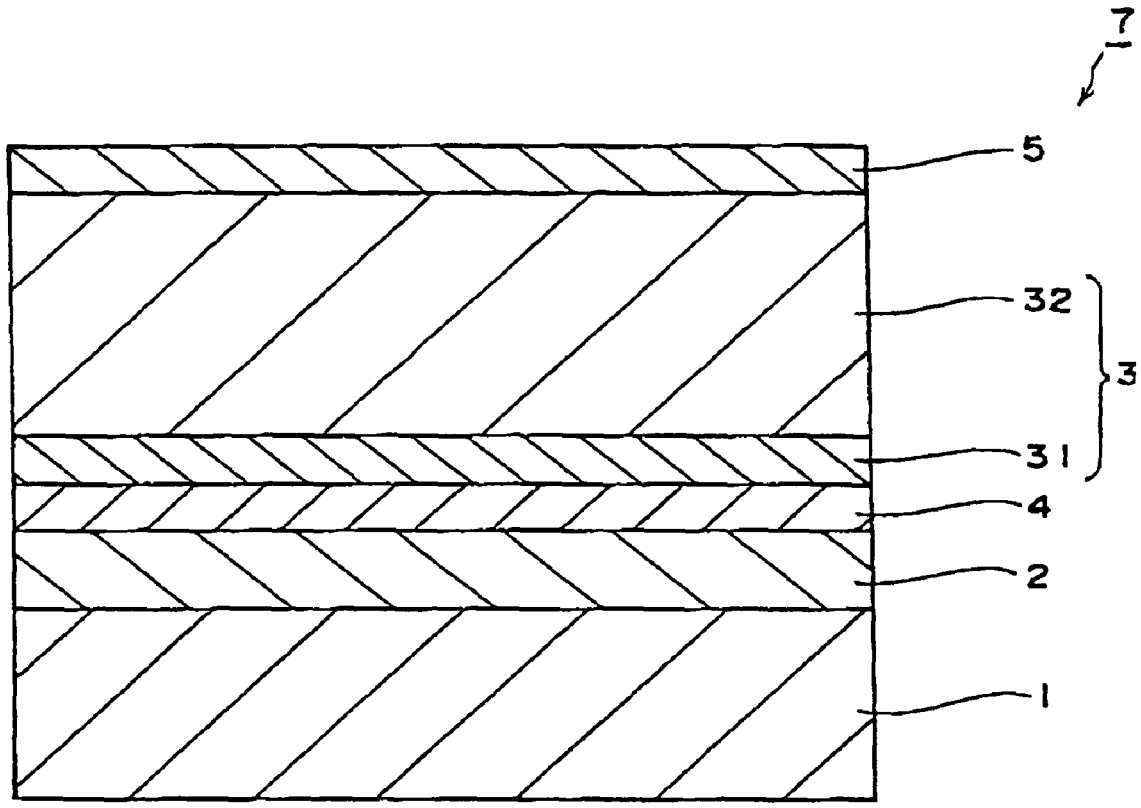
FIG. 1 is a schematic sectional view illustrating an embodiment of the electrophotographic photoreceptor according to the present invention.

After present intensive studies, the inventions have found that the problems above can be solved by an electrophotographic photoreceptor having at least an undercoat layer and a photosensitive layer formed on a conductive substrate, wherein the undercoat layer contains metal oxide fine particles and an electron acceptor compound having a group reactive with the metal oxide fine particles.

Namely, use of an electrophotographic photoreceptor according to the invention that employs an undercoat layer containing metal oxide fine particles and an electron acceptor compound having a group reactive with the metal oxide fine particles formed on a conductive substrate enables stabilization of the electrical properties of the electrophotographic apparatus during long-term use and thus formation of favorable-quality images with a smaller number of image quality defects such as background fog, black spot, ghost, and the like. It also prevents leakage sufficiently, even when the electrophotographic photoreceptor is damaged by foreign substance derived from other members around the electrophotographic photoreceptor or dusts brought in from outside of the electrophotographic apparatus. As a result, it ensures sufficiently favorable image quality for a longer period of time.

The reasons for the advantageous effects of the invention is yet to be understood, but the inventors assume as followings:

A thickened undercoat layer containing metal oxide particles was effective in preventing leakage even when the electrophotographic photoreceptor is damaged with foreign substances derived from other members around the electrophotographic photoreceptor or dusts brought in from outside of the electrophotographic apparatus, but not effective in retaining the favorable electrical properties during long-term use. It seems that electric charges are accumulated in the undercoat layer or at the vicinity of the interface between the undercoat and upper layers during long-term repeated use.

If the undercoat layer contains an electron acceptor compound having a group reactive with metal oxide particles, the electron acceptor compound, which is reacted with and bound to the metal oxide fine particles in the undercoat layer, aids the charge transfer at the interface between the undercoat and upper layers and also prevents entrapment of electric charges in the undercoat layer, thus suppressing increase in the residual electric potential thereof during long-term use.

Hereinafter, favorable embodiments of the invention will be described in detail occasionally with reference to drawings. In the drawings, identical numbers are allocated to the same or similar parts, for elimination of duplicated description.

(Electrophotographic Photoreceptor)

Figure 2:
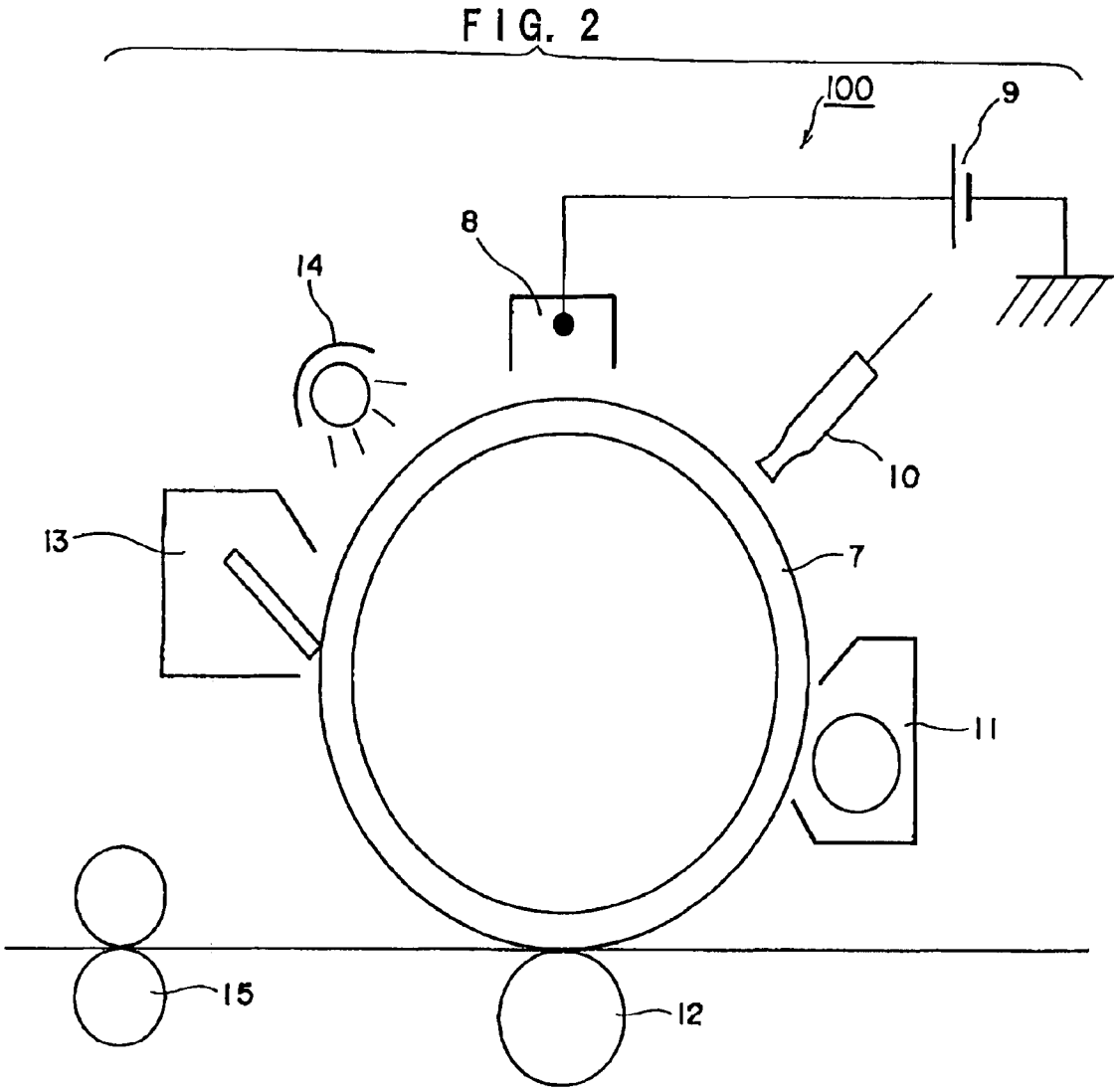
FIG. 2 is a schematic view illustrating a favorable embodiment of the electrophotographic apparatus according to the invention.

FIG. 1 is a schematic sectional view illustrating an example of the electrophotographic photoreceptor according to the invention. The electrophotographic photoreceptor 7 has a structure in which an undercoat layer 2, an intermediate layer 4, a photosensitive layer 3 and a overcoat layer 5 are laminated in that order on a conductive substrate 1. The electrophotographic photoreceptor 7 shown in FIG. 2 is a functionally separated layered photoreceptor, in which the photosensitive layer 3 further contains a charge-generating layer 31 and a charge-transporting layer 32.

Examples of the conductive substrates 1 include metal drums of metals such as aluminum, copper, iron, stainless steel, zinc, and nickel; base materials such as sheet, paper, plastic, and glass deposited with a metal such as aluminum, copper, gold, silver, platinum, palladium, titanium nickel chromium, stainless steel, copper, or indium, and with a conductive metal compound such as indium oxide, tin oxide, or the like; the base materials above laminated with a metal foil; conductive substrates above coated with a dispersion of carbon black, indium oxide, tin oxide, antimony oxide powder, metal powder, copper iodide or the like in a binder resin; and the like.

The conductive substrate 1 is not restricted to the shape of drum, and may have a sheet or plate-like shape. When the conductive substrate 1 is a metal pipe, the surface of the pipe may be bare or finished, for example, by mirror surface grinding, etching, anodic oxidation, rough grinding, centerless grinding, sand blasting, wet honing, or the like.

The undercoat layer 2 is formed with metal oxide fine particles and an electron acceptor compound having a group reactive with the metal oxide fine particles.

The metal oxide fine particles for use in the invention have a powder resistance of approximately $10^2$ to $10^{11}$ Ω·cm. It is because the undercoat layer needs to have a suitable powder resistance for obtaining a certain leak resistance. Among many metal oxide particles, use of the fine particles of a metal oxide such as titanium oxide, zinc oxide, tin oxide, or zirconium oxide having a resistance in the range above is preferable. Zinc oxide is particularly preferable. Metal oxide fine particles having a resistance lower than the lowest value of the range above may not provide a sufficiently high leak resistance, while those having a resistance higher than the highest value of the range may lead to increase in residual electric potential. The metal oxide fine particles may be used in combination of two or more kinds of particles, for example, different in surface finish or in particle diameter. In addition, the metal oxide fine particles preferably have a specific surface area of 10 $m^2/g$ or more. Particles having a specific surface area of 10 $m^2/g$ or less have a drawback of causing deterioration in electrostatic properties and thus prohibiting favorable electrophotographic properties.

The metal oxide fine particles may be subjected to a surface treatment. The surface-finishing agent may be selected from known materials such as silane coupling agents, titanate coupling agents, aluminum coupling agents, and surface-active agents if the material can provide desired properties. In particular, use of a silane-coupling agent, which provides favorable electrophotographic properties, is preferable. An amino group-containing silane coupling agent is used more preferably in the undercoat layer, because it provides a favorable blocking property.

The amino group-containing silane coupling agent is not particularly limited if it can provide the photoreceptor with favorable properties, and typical examples thereof include, but are not limited to, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and the like. The silane-coupling agents may be used in combination of two or more. Examples of the silane coupling agents that may be used together with the amino group-containing silane coupling agent include, but are not limited to, vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxylsilane, γ-chloropropyltrimethoxysilane, and the like.

Any known method, either a dry or wet method, may be used for the surface treatment.

When the surface treatment is carried out by a dry method, metal oxide fine particles are uniformly processed by adding a silane coupling agent directly or adding a solution thereof in an organic solvent and spraying the drops with a dry air or nitrogen gas stream onto the metal oxide particles while agitating the metal oxide particles in a high-shear-force mixer. During addition or spraying, the temperature is preferably kept lower than the boiling point of the solvent. Spraying at a temperature of the boiling point of the solvent or higher, which causes evaporation of the solvent before the silane coupling agent is uniformly distributed and local aggregation of the silane coupling agent and thus prohibits uniform processing, is disadvantageous and undesirable. The metal oxide fine particles after addition or spraying may be baked additionally at 100° C. or more. The baking may be carried out under any condition if it is suitable temperature and time for obtaining desirable electrophotographic properties.

In the wet methods, metal oxide fine particles are processed uniformly by dispersing the metal oxide fine particle in a solvent by means of a agitator, ultrasonicator, sand mill, attriter, ball mill, or the like, adding a silane coupling agent solution thereto, stirring or dispersing the resulting mixture, and removing the solvent. The solvent is commonly removed by filtration or distillation. The metal oxide fine particles may be baked additionally at a temperature of 100° C. or more after removing the solvent. The baking may be carried out under any condition if it is suitable temperature and time for obtaining desirable electrophotographic properties. Water contained in the metal oxide fine particles may be removed before addition of a surface finishing agent in the wet method, for example, by heating and stirring the particles in a solvent for surface treatment or by azeotropic distillation with the solvent.

The amount of the silane-coupling agent with respect to the metal oxide fine particles in the undercoat layer 2 may be freely selected if it is suitable for providing desired electrophotographic properties.

Any compound may be used as the electron acceptor compound according to the invention if it has a group reactive with the metal oxide fine particles providing desired properties, and in particular, a compound laving a hydroxyl group is preferable. An electron acceptor compound having an anthraquinone structure containing a hydroxyl group is particularly preferable. Examples of the electron acceptor compounds having an anthraquinone structure containing a hydroxyl group include hydroxyanthraquinone compounds, aminohydroxyanthraquinone compounds, and the like, and any compound may be used favorably. Specific favorable examples of the electron acceptor compounds include alizarin, quinizarin, anthrarufin, purpurin, 1-hydroxyanthraquinone, 2-amino-3-hydroxyanthraquinone, 1-amino-4-hydroxyanthraquinone, and the like.

The content of the electron acceptor compound used in the invention may be freely determined in the range that provides desired properties, and is preferably in the range of 0.01 to 20 weight % and more preferably in the range of 0.05 to 10 weight % with respect to metal oxide fine particles. Metal oxide fine particles having an electron acceptor content of 0.01 weight % or less may not be effective in providing a sufficient electron acceptor capacity for preventing the accumulation of electric charges in undercoat layer and often result in deterioration in the consistency of photoreceptor, for example, increase of residual electric potential during repeated use. Alternatively, an electron acceptor compound having a content of 20 weight % or more may cause aggregation of metal oxide particles, which prohibit formation of favorable conductive paths in the undercoat layer when the undercoat layer is formed, leading to deterioration in consistency, for example, increase of residual electric potential during repeated use and consequently image quality defects such as black spot and the like.

The binder resin contained in the undercoat layer 2 is not particularly limited if it gives a favorable film and provides the film with desired properties, and examples thereof include known polymer compounds including acetal resins such as polyvinyl butyral, polyvinyl alcohol resins, casein, polyamide resins, cellulosic resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins; electric charge-transporting resins having a charge-transporting group; conductive resins such as polyaniline; and the like. Among them, a resin insoluble in the coating solution for upper layer is preferable, and favorable examples thereof include phenol resins, phenol-formaldehyde resins, melamine resins, urethane resins, epoxy resins and the like.

The ratio of the metal oxide fine particle to the binder resin in the coating solution for forming the undercoat layer may be selected freely in the range that provides the electrophotographic photoreceptor with desirable properties.

The coating solution for forming the undercoat layer may contain additionally various additives, for improvement in electrical properties, environment stability, and/or image quality.

Examples of such additives include electron-transporting material including quinone compound such as chloranil and bromoanil, tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)1,3,4-oxadiazole, xanthone compounds, thiophene compounds, and diphenoquinone compounds such as 3,3',5,5'-tetra-t-butyldiphenoquinone; electron transporting pigments such as polycyclic condensation pigments and azo pigments; known materials such as zirconium chelate compounds, titanium chelate compounds, aluminum chelate compounds, titanium alkoxide compounds, organic titanium compounds, and silane coupling agents; and the like. Silane coupling agents are used for surface treatment of metal oxides, but may be used also as an additive in the coating solution. Typical examples of the silane coupling agents usable include vinyltrimethoxysilane, γ-methacryloxypropyl-tris(β-methoxyethoxy) silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, γ-chloropropyltrimethoxysilane, and the like. Examples of the zirconium chelate compounds include zirconium butoxide, zirconium ethylacetoacetate, zirconium triethanolamine, acetylacetonatozirconium butoxide, ethylacetoacetatozirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylatozirconium butoxide, stearatozirconium butoxide, isostearatozirconium butoxide, and the like.

Examples of the titanium chelate compounds include tetraisopropyl titanate, tetra-n-butyl titanate, butyl titanate dimer, tetra(2-ethylhexyl) titanate, titanium acetylacetonate, poly titanium acetylacetonate, titanium octyleneglycolate, titanium lactate ammonium salt, titanium lactate, titanium lactate ethylester, titanium triethanolaminate, polyhydroxytitanium stearate, and the like.

Examples of the aluminum chelate compounds include aluminum isopropylate, monobutoxyaluminum diisopropylate, aluminum butylate, diethylacetoacetatoaluminum diisopropylate, aluminum tris(ethylacetoacetate), and the like.

These compounds may be used alone or as a mixture or polycondensate of multiple compounds.

The solvent for preparing the coating solution for forming the undercoat layer may be selected freely from known organic solvents: for example, alcohols, aromatic hydrocarbons, halogenated hydrocarbons, ketones, ketone alcohols, ethers, and esters. For example, common organic solvents such as methanol, ethanol, n-propanol, iso-propanol, n-butanol, benzylalcohol, methylcellusolve, ethylcellusolve, acetone, methylethylketone, cyclohexanone, methyl acetate, ethyl acetate, n-butyl acetate, dioxane, tetrahydrofuran, methylene chloride, chloroform, chlorobenzene, and toluene may be used.

In addition, the solvents above for dispersion may be used alone or as a mixture of two or more. Any solvents may be used as the solvents for use in the mixture, if the mixed solvent can dissolve the binder resin.

The metal oxide fine particles and the electron acceptor compound having a group reactive with the metal oxide fine particles may be blended by any one of known-means including roll mill, ball mill, vibration ball mill, attriter, sand mill, colloid mill, and paint shaker. Further, the undercoat layer 2 may be formed by any one of the methods commonly practiced in the art including blade coating, wire bar coating, spray coating, dip coating, bead coating, air knife coating, curtain coating, and other methods.

The metal oxide fine particles may be allowed to react with the electron acceptor compound having a group reactive with the metal oxide fine particles in the undercoat layer 2 either in the dispersion process or coated film-drying/hardening step, but is preferably in the dispersion step for facilitating a more uniform reaction.

The undercoat layer 2 is formed on a conductive substrate by using the coating solution for forming undercoat layer thus obtained.

The undercoat layer 2 preferably has a Vickers' strength of 35 or more.

The undercoat layer 2 may have any thickness if it can provide desired properties, but preferably has a thickness of 15 μm or more and more preferably 15 μm or more and 50 μm or less.

An undercoat layer 2 having a thickness of less than 15 μm may have a drawback of not providing sufficient anti-leak properties, while an undercoat layer having a thickness of 50 μm or more a drawback of leading to image density abnormality due to the residual electric potential remaining during long-term use.

The surface roughness of the undercoat layer 2 is adjusted to ¼n (n represents the refractive index of upper layer) to ½ of the wavelength λ of the exposure laser used for prevention of moire images. Resin particles may be added to the undercoat layer for adjustment of the surface roughness. The usable resin particles are, for example, silicone resin particles, cross-linked PMMA resin particles, or the like.

Alternatively, the undercoat layer may be polished for adjustment of the surface roughness. The polishing methods include buffing, sand blasting, wet honing, grinding treatment, and the like.

In addition, an intermediate layer 4 may be formed between the undercoat layer 2 and the photosensitive layer 3 for improvement in the electrical properties, image quality, image quality endurance, and the adhesiveness of photosensitive layer.

The intermediate layer 4 contains a polymer resin compound such as acetal resin represented by polyvinyl butyral, polyvinyl alcohol resin, casein, polyamide resin, cellulosic resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol-formaldehyde resin, melamine resin, or the like; as well as an organic metal compound containing a zirconium, titanium, aluminum, manganese, silicon, or other atom. These compounds may be used alone or as a mixture or polycondensate of multiple compounds. Among them, zirconium or a silicon-containing organic metal compound is superior in properties, as it has a lower residual electric potential, a smaller fluctuation in electric potential by the environment, and a smaller fluctuation in electric potential by repeated use.

Examples of the silicon compounds include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxylsilane, γ-chloropropyltrimethoxysilane, and the like. The silicon compounds particularly favorably used among them include vinyltriethoxysilane, vinyltris(2-methoxyethoxy)silane, 3-methacryloxypropyltrimethoxysilane, 3-glycidoxypropyltrimethoxysilane, 2-(3,4-epoxycyclohexyl)ethyltrimethoxysilane, N-2-(aminoethyl)3-aminopropyltrimethoxysilane, N-2-(aminoethyl)3-aminopropylmethylmethoxysilane, 3-aminopropyltriethoxylsilane, N-phenyl-3-aminopropyltrimethoxysilane, 3-mercaptopropyltrimethoxysilane, 3-chloropropyltrimethoxysilane, and the like.

Examples of the organic zirconium compounds include zirconium butoxide, zirconium ethylacetoacetate, zirconium triethanolamine, acetylacetonatozirconium butoxide, ethylacetoacetatozirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylatozirconium butoxide, stearatozirconium butoxide, isostearatozirconium butoxide, and the like.

Examples of the organic titanium compounds include tetraisopropyl titanate, tetra-n-butyl titanate, butyl titanate dimer, tetra(2-ethylhexyl) titanate, titanium acetylacetonate, poly titanium acetylacetonate, titanium octyleneglycolate, titanium lactate ammonium salt, titanium lactate, titanium lactate ethylester, titanium triethanolaminate, polyhydroxytitanium stearate, and the like.

Examples of the organic aluminum compounds include aluminum isopropylate, monobutoxyaluminum diisopropylate, aluminum butylate, diethylacetoacetatoaluminum diisopropylate, aluminum tris(ethylacetoacetate), and the like.

The intermediate layer 4 plays roles of improving the coating property of the upper layer as well as an electrical blocking layer, but the layer having a larger thickness may become more resistant electrically, leading to decrease in sensitivity and increase in electric potential by repeated use. Accordingly, if formed, the intermediate layer 4 has a thickness in the range of 0.1 to 5 μm.

The charge-generating layer 31 in the photosensitive layer 3 is formed by vacuum deposition of a charge-generating substance or by coating of the dispersion thereof together with a binder resin in an organic solvent.

If a charge-generating layer 31 is formed by dispersion coating, the charge-generating layer 31 is formed by dispersing a charge-generating substance together with a binder resin, additives, and others in an organic solvent, and coating the dispersion thus obtained.

In the invention, any known charge-generating substance may be used as the charge-generating substance. Examples thereof for infrared light include phthalocyanine pigments, squarylium compounds, bisazo compounds, trisazo pigments, perylene compounds, dithioketopyrrolopyrrole; and those for visible light, condensation polycyclic pigments, bisazo compounds, perylene compounds, trigonal selenium compounds, dye-sensitized zinc oxide fine particles, and the like. Charge-generating materials particularly favorably used among them because they provide excellent properties are phthalocyanine pigments and azo pigments. Use of the compound allows production of an electrophotographic photoreceptor 7 particularly higher in sensitivity and superior in repetition stability. Phthalocyanine pigments and azo pigments generally have several crystal forms, and such pigment in any one of these crystal forms may be used if it can provide desirable electrophotographic properties. Charge-generating materials particularly favorably used include chlorogallium phthalocyanine, dichlorotin phthalocyanine, hydroxygallium phthalocyanine, non-metal phthalocyanine, hydroxytitanylphthalocyanine, chloroindium phthalocyanine, and the like.

The phthalocyanine pigment crystals may be prepared by dry pulverization of a phthalocyanine pigment prepared by a known method mechanically in an automatic mortar, planetary mill, vibrating mill CF mill, roller mill, sand mill, kneader, or the like; or by wet pulverization additionally of the crystal after dry pulverization together with a solvent in a ball mill, mortar, sand mill, kneader, or the like.

Examples of the solvent used in the processing above include aromatic compounds (toluene, chlorobenzene, etc.), amides (dimethylformamide, N-methylpyrrolidone, etc.), aliphatic alcohols (methanol, ethanol, butanol, etc.), aliphatic polyvalent alcohols (ethylene glycol, glycerol, polyethylene glycol, etc.), aromatic alcohols (benzyl alcohol, phenethyl alcohol, etc.), esters (acetic acid esters, butyl acetate, etc.), ketones (acetone, methylethylketone, etc.), dimethylsulfoxide, ethers (diethylether, tetrahydrofuran, etc.), as well as several-solvent mixture systems, mixture systems of these organic solvents and water. The solvent is used in the range of 1 to 200 parts, preferably 10 to 100 parts by weight, with respect to the pigment crystal. The processing temperature is in the range of −20° C. to the boiling point of the solvent and more preferably in the range of −10 to 60° C. A grinding aid such as sodium chloride or sodium sulfate may additionally used during pulverization. The grinding aid is used in an amount of 0.5 to 20 times, preferably 1 to 10 times, of that of the pigment.

The crystalline state of phthalocyanine pigment crystals prepared by a known method can be controlled by acid pasting or by a combination of acid pasting and the dry or wet pulverization described above. A favorable acid for the acid pasting is sulfuric acid at a concentration of 70 to 100%, preferably 95 to 100%, and the favorable solubilization temperature is in the range of −20 to 100° C. and preferably in the range of −10 to 60° C. The amount of the conc. sulfuric acid solution is in the range of 1 to 100 times, preferably 3 to 50 times larger than that of phthalocyanine pigment crystal. Water or a mixture of water and an organic solvent is used in an arbitrary amount as a precipitation solvent. The precipitation temperature is not particularly limited, but the pigment solution is preferably cooled, for example, with ice for prevention of overheating.

The binder resin for use in the charge-generating layer 31 may be selected from a wide range of insulating resins and organic photoconductive polymers such as poly-N-vinylcarbazole, polyvinylanthracene, polyvinylpyrene, and polysilane. Favorable examples of the binder resins include, but are not limited to, insulating resins such as polyvinyl acetal resins, polyarylate resins (polycondensation polymers from bisphenol A and phthalic acid), polycarbonate resins, polyester resins, phenoxy resins, vinyl chloride-vinyl acetate copolymers, polyamide resins, acrylic resins, polyacrylamide resins, polyvinylpyridine resins, cellulosic resins, urethane resins, epoxy resins, casein, polyvinyl alcohol resins, polyvinylpyrrolidone resins. These binder resins may be used alone or in combination of two or more. Polyvinyl acetal resins are particularly preferably used among them.

In the coating solution for forming the charge-generating layer, the blending ratio (weight ratio) of the charge-generating substance to the binder resin is preferably in the range of 10:1 to 1:10. The solvent for preparation of the coating solution is selected arbitrarily form known organic solvents such as alcohols, aromatic compounds, halogenated hydrocarbons, ketones, ketone alcohols, ethers, esters, and the like. For example, common organic solvent such as methanol, ethanol, n-propanol, iso-propanol, n-butanol, benzyl alcohol, methylcellusolve, ethylcellusolve, acetone, methylethylketone, cyclohexanone, methyl acetate, ethyl acetate, n-butyl acetate, dioxane, tetrahydrofuran, methylene chloride, chloroform, chlorobenzene, and toluene may be used.

The solvents for dispersion may be used alone or in combination of two or more. Any solvent may be used for mixing if it is capable of dissolving the binder resin.

The binder resin is dispersed, for example, in a roll mill, ball mill, vibration ball mill, attriter, sand mill, colloid mill, paint shaker or the like. The charge-generating layer 31 may be applied by any one of common methods including blade coating, wire bar coating, spray coating, dip coating, bead coating, air knife coating, and curtain coating methods.

In addition, control of the diameter of the particles in the dispersion to 0.5 μm or less, preferably 0.3 μm or less, and more preferably 0.15 μm or less, is effective for improvement in sensitivity and stability.

The surface of the charge-generating substance may be additionally treated for stabilization of electrical properties and prevention of image quality defects. The surface treatment agents include, but are not limited to, coupling agents. Examples of the coupling agents for use in the surface treatment include silane coupling agents such as vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxylsilane, and γ-chloropropyltrimethoxysilane. Silane coupling agents particularly favorably used among them include vinyltriethoxylsilane, vinyltris(2-methoxyethoxy)silane, 3-methacryloxypropyltrimethoxysilane, 3-glycidoxypropyltrimethoxysilane, 2-(3,4-epoxycyclohexyl) ethyltrimethoxysilane, N-2-(aminoethyl)-3-aminopropyltrimethoxysilane, N-2-(aminoethyl)-3-aminopropylmethyldimethoxysilane, 3-aminopropyltriethoxylsilane, N-phenyl-3-aminopropyltrimethoxysilane, 3-mercaptopropyltrimethoxysilane, and 3-chloropropyl trimethoxysilane.

Further, organic zirconium compounds including zirconium butoxide, zirconium ethylacetoacetate, zirconium triethanolamine, acetylacetonatozirconium butoxide, ethylacetoacetatozirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylatozirconium butoxide, stearatozirconium butoxide, isostearatozirconium butoxide, and the like may also be used.

In addition, organic titanium compounds such as tetraisopropyl titanate, tetra-n-butyl titanate, butyl titanate dimer, tetra(2-ethylhexyl)titanate, titanium acetylacetonate, polytitanium acetylacetonate, titanium octyleneglycolate, titanium lactate ammonium salt, titanium lactate, titanium lactate ethylester, titanium triethanolaminate, and polyhydroxytitanium stearate; and organic aluminum compounds such as aluminum isopropylate, monobutoxyaluminum diisopropylate, aluminum butylate, diethylacetoacetatoaluminum diisopropylate and aluminum tris(ethylacetoacetate) may also be used.

Various additives may be added additionally to the coating solution for the charge-generating layer for improvement in electrical properties and image quality. Examples of the additives include electron-transporting materials including quinone compounds such as chloranil, bromoanil and anthraquinone; tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenyl)1,3,4-oxadiazole, xanthone compounds, thiophene compounds, and diphenoquinone compounds such as 3,3',5,5'-tetra-t-butyl diphenoquinone; electron-transporting pigments such as polycyclic condensation and azo pigments; known materials such as zirconium chelate compounds, titanium chelate compounds, aluminum chelate compounds, titanium alkoxide compounds, organic titanium compounds, and silane coupling agents; and the like.

Examples of the silane coupling agents include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxylsilane, γ-chloropropyltrimethoxysilane, and the like.

Examples of the zirconium chelate compounds include zirconium butoxide, zirconium ethylacetoacetate, zirconium triethanolamine, acetylacetonatozirconium butoxide, ethylacetoacetatozirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylatozirconium butoxide, stearatozirconium butoxide, isostearatozirconium butoxide, and the like.

Examples of the titanium chelate compounds include tetraisopropyl titanate, tetra-n-butyl titanate, butyl titanate dimer, tetra(2-ethylhexyl)titanate, titanium acetylacetonate, poly titanium acetylacetonate, titanium octyleneglycolate, titanium lactate ammonium salt, titanium lactate, titanium lactate ethylester, titanium triethanolaminate, polyhydroxytitanium stearate, and the like.

Examples of the aluminum chelate compounds include aluminum isopropylate, monobutoxyaluminum diisopropylate, aluminum butylate, diethylacetoacetatoaluminum diisopropylate, aluminum tris(ethylacetoacetate), and the like.

These compounds may be used alone or as a mixture or polycondensate of multiple compounds.

The charge-generating layer 31 may be formed by any one of methods commonly practiced in the art including blade coating, wire bar coating, spray coating, dip coating, bead coating, air knife coating, curtain coating, and other methods.

Any known charge-transporting compound may be used as the charge-transporting substance contained in the charge-transporting layer 32, and examples thereof include: hole-transporting materials including oxadiazole derivatives such as 2,5-bis(p-diethylaminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylaminostyryl)pyrazoline, aromatic tertiary amino compounds such as triphenylamine, tri(p-methyl)phenylamine, N,N'-bis(3,4-dimethylphenyl)-biphenyl-4-amine, dibenzylaniline, and 9,9-dimethyl-N,N'-di(p-tolyl)fluorenon-2-amine, aromatic tertiary diamino compounds such as N,N'-diphenyl-N,N'-bis(3-methylphenyl)-[1,1-biphenyl]-4,4'-diamine, 1,2,4-triazine derivatives such as 3-(4'-dimethylaminophenyl)-5,6-di-(4-methoxyphenyl)-1,2,4-triazine, hydrazone derivatives such as 4-diethylaminobenzaldehyde-1,1-diphenyl hydrazone, 4-diphenylaminobenzaldehyde-1,1-diphenylhydrazone, and [p-(diethylamino)phenyl](1-naphthyl)phenylhydrazone, quinazoline derivatives such as 2-phenyl-4-styrylquinazoline, benzofuran derivatives such as 6-hydroxy-2,3-di(p-methoxyphenyl)-benzofuran, α-stilbene derivatives such as p-(2,2-diphenylvinyl)-N,N'-diphenylaniline, enamine derivatives, carbazole derivatives such as N-ethylcarbazole, poly-N-vinyl carbazole and the derivatives thereof; and electron-transporting materials including quinone compounds such as chloranil, bromoanil, and anthraquinone, tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethyl amino phenyl)1,3,4-oxadiazole, xanthone compounds, thiophene compounds, diphenoquinone compound such as 3,3',5,5"-tetra-t-butyldiphenoquinone; and polymers having groups containing the compounds above on the main or side chains, and the like. These charge-transporting substances may be used alone or in combination of two or more.

Among these compounds, compounds having the following structural formulae (A) to (C) are preferable from the viewpoint of mobility.

(A)

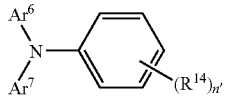

wherein, in the formula (A), $R^{14}$ represents a methyl group; n' represents an integer of 0-2; $Ar^6$ and $Ar^7$ each represents a substituted or non-substituted aryl group, —C($R^{18}$)═C($R^{19}$)($R^{20}$), or —CH═CH—CH═C(Ar)$_2$, in which a substituent is a halogen atom, an alkyl group with 1-5 carbon atoms, an alkoxy group with 1-5 carbon atoms or a substituted amino group substituted with an alkyl group with 1-3 carbon atoms, Ar represents a substituted or non-substituted aryl group, $R^{18}$, $R^{19}$ and $R^{20}$ each represents a hydrogen atom, a substituted or non-substituted alkyl group, or a substituted or non-substituted aryl group:

(B)

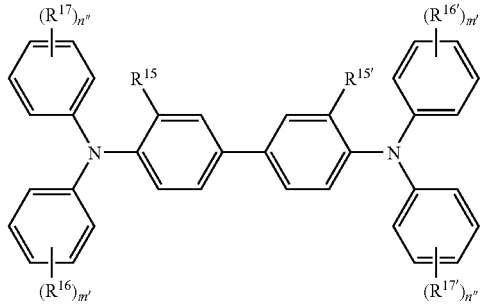

wherein, in the formula (B), $R^{15}$ and $R^{15'}$ may be mutually same or different and each represents a hydrogen atom, a halogen atom, an alkyl group with 1-5 carbon atoms, or an alkoxy group with 1-5 carbon atoms; $R^{16}$, $R^{16'}$, $R^{17}$ and $R^{17'}$ may be mutually same or different and each represents a hydrogen atom, a halogen atom, an alkyl group with 1-5 carbon atoms, an alkoxy group with 1-5 carbon atoms, an amino group substituted with an alkyl group with 1-2 carbon atoms, a substituted or non-substituted aryl group, —C($R^{18}$)═C($R^{19}$($R^{20}$), or —CH═CH—CH═C(Ar')$_2$, in which Ar' represents a substituted or non-substituted aryl group, and $R^{18}$, $R^{19}$ and $R^{20}$ each represents a hydrogen atom, a substituted or non-substituted alkyl group or a substituted or non-substituted aryl group; and m' and n' each represents an integer of 0-2: and (C)

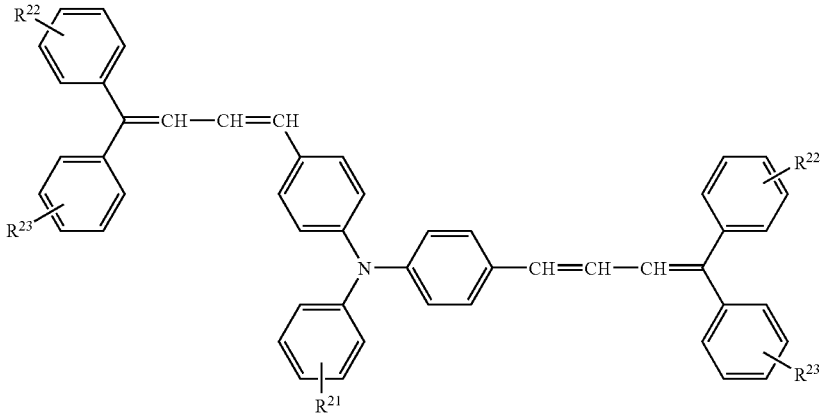

wherein, in the formula (C), $R^{21}$ represents a hydrogen atom, an alkyl group with 1-5 carbon atoms, an alkoxy group with 1-5 carbon atoms, a substituted or non-substituted aryl group, or —CH═CH—CH═C(Ar")$_2$, in which Ar" represents a substituted or non-substituted aryl group; $R^{22}$ and $R^{23}$ may be mutually same or different, and each represents a hydrogen atom, a halogen atom, an alkyl group with 1-5 carbon atoms, an alkoxy group with 1-5 carbon atoms, an amino group substituted with 1-2 carbon atoms, or a substituted or non-substituted aryl group.

A binder resin of the charge transport layer 23 may be any known resin, but is preferably a resin capable of forming an electroinsulating film.

For example there can be employed an insulating resin such as a polycarbonate resin, a polyester resin, a polyarylate resin, a methacrylic resin, an acrylic resin, a polyvinyl chloride resin, a polyvinylidene chloride resin, a polystyrene resin, an acrylonitrile-styrene copolymer, an acrylonitrile-butadiene copolymer, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-carbazole, polyvinylbutyral, polyvinylformal, polysulfon, casein, gelatin, polyvinyl alcohol ethyl cellulose, phenol resin, polyamide, polyacrylamide, carboxy-methyl cellulose, vinylidene chloride-based polymer wax, or polyurethane, or a polymer charge transport material such as polyvinylcarbazole, polyvinylanthracene, polyvinylpyrene, polysilane or a polyester-based polymer charge transport material disclosed in JP-A Nos. 8-176293 and 8-208820.

Such binder resin may be employed singly or in a mixture of two or more kinds. Such binder resin, which can be employed singly or in a mixture of two or more kinds, is particularly preferably a polycarbonate resin, a polyester resin, a methacrylic resin or an acrylic resin in consideration of a mutual solubility with the charge transport material, a solubility in the solvent and a strength. A composition ratio (weight ratio) of the binder resin and the charge transfer substance can be arbitrarily selected in any case, but attention has to be paid to decreases in the electrical characteristics and in the film strength.

It is also possible to use a polymer charge transport material singly. As the polymer charge transport material any known material having a charge transport property such as poly-N-vinylcarbazole or polysilane may be employed. In particular, a polyester polymer charge transport material disclosed in JP-A Nos. 8-176293 and 8-208820 is particularly preferable, having a high charge transporting property. The polymer charge transport material may be singly used as the charge transport layer, but it may formed into a film in a mixture with the aforementioned binder resin.

The charge transport layer 32, in case it is a surface layer of the electrophotographic photoreceptor (namely a layer in the photosensitive layer farthest from the conductive substrate), preferably contains lubricating particles (such as silica particles, alumina particles, fluorinated resin particles such as of polytetrafluoroethylene (PTFE), or silicone resin particles) for providing a lubricating property thereby retarding abrasion of the surface layer or avoiding scratches, and improving a cleaning property for a developer deposited on the surface of the photoreceptor. Such lubricating particles may be employed in a mixture of two or more kinds. In particular, fluorinated resin particles can be employed preferably.

For the fluorinated resin particles, one or more kinds are preferably selected from a tetrafluoroethylene resin, a trifluorochloroethylene resin, a hexafluoropropylene resin, a fluorinated vinyl resin, a fluorinated vinylidene resin, a difluorodichloroethylene resin and copolymers thereof, and a tetrafluoroethylene resin or a fluorinated vinylidene resin is particularly preferable.

The aforementioned fluorinated resin preferably has a primary particle size of 0.05 to 1 μm, more preferably 0.1 to 0.5 μm. A primary particle size less than 0.05 μm may tend to result in an agglomeration at or after dispersing operation. Also a size exceeding 1 μm may tend to generate image defects.

In a charge transport layer containing a fluorinated resin, a content of the fluorinated resin in the charge transport layer is preferably 0.1 to 40 weight % with respect to the entire amount of the charge transport layer, particularly preferably 1 to 30 weight %. A content less than 1 weight % may be insufficient for a modifying effect by the dispersed fluorinated resin particles, while a content exceeding 40 weight % may deteriorate an optical transmittance and may cause an increase in the residual potential in repeated uses.

The charge transport layer 32 can be prepared by coating and drying a coating liquid for the charge transport layer, prepared by dissolving the charge transport material, the binder resin and other materials in a suitable solvent.

A solvent to be used for forming the charge transport layer 32 can be an aromatic hydrocarbon solvent such as toluene or chlorobenzene, an aliphatic alcohol solvent such as methanol, ethanol or n-butanol, a ketone solvent such as acetone, cyclohexanone or 2-butanone, a halogenated aliphatic hydrocarbon solvent such as methylene chloride, chloroform or ethylene chloride, a cyclic or linear ether solvent such as tetrahydrofuran, dioxane, ethylene glycol or diethyl ether, or a mixed solvent thereof. A composition ratio of the charge transport material and the binder resin is preferably 10:1 to 1:5.

In the coating liquid for forming the charge transport layer, a small amount of a leveling agent such as silicone oil may be added for improving smoothness of the coated film.

The fluorinated resin can be dispersed in the charge transport layer 32 for example with a roll mill, a ball mill, a vibrating ball mill, an attriter, a sand mill, a high pressure homogenizer, an ultrasonic disperser, a colloid mill, a collision type medialess disperser or a penetration type medialess disperser.

The coating liquid for forming the charge transport layer 32 can be prepared, for example, by dispersing fluorinated resin particles in a solution formed by dissolving the binder resin, the charge transport material and the like in the solvent.

In a process of preparing the coating liquid for forming the charge transport layer 32, the coating liquid is preferably controlled within a temperature range of 0 to 50° C.

For controlling the temperature of the coating liquid at 0-50° C. in the coating liquid manufacturing process, there can be utilized a method of cooling with water, a method of cooling with wind, a method of cooling with a coolant, a method of regulating a room temperature in the manufacturing process, a method of warming with warm water, a method of warming with hot air, a method of warming with a heater, a method of preparing a coating liquid manufacturing facility with a material that does not generate heat easily, a method of preparing a coating liquid manufacturing facility with a material capable of easy heat dissipation, or a method of preparing a coating liquid manufacturing facility with a material capable of easy heat accumulation.

An addition of a small amount of an auxiliary dispersant is also effective for improving the dispersion stability of the dispersed liquid and for preventing agglomeration in forming a coated film. The auxiliary dispersant can be a fluorinated surfactant, a fluorinated polymer, a silicone polymer or a silicone oil. It is also effective to in advance disperse, agitate and mix the fluorinated resin and the aforementioned auxiliary dispersant in a small amount of a dispersing solvent, then agitate and mix thus obtained dispersion with a solution formed by mixing and dissolving the charge transport material, the binder resin and the dispersing solvent, and then executing a dispersion in the afore-mentioned method.

A coating method for forming the charge transport layer 32 can be, for example, a dip coating method, a fountain extrusion coating method, a spray coating method, a roll coating method, a wire bar coating method, a gravure coating method, a bead coating method, a curtain coating method, a blade coating method or an air knife coating method.

The charge transport layer 32 preferably has a film thickness of 5 to 50 μm, more preferably 10 to 45 μm.

Furthermore, in the electrophotographic photoreceptor of the present invention, an additive such as an antioxidant or a photostabilizer can be added in the photosensitive layer 3, for the purpose of preventing deterioration of the electrophotographic photoreceptor by ozone or an oxidative gas generated in the electrophotographic apparatus or by light or heat.

The antioxidant can be, for example, hindered phenol, hindered amine, paraphenylenediamine, arylalkane, hydroquinone, spirocumaron, spiroindanone, a derivative of the foregoing compounds, an organic sulfur compound or an organic phosphor compound.

Specific examples of the antioxidant, in a phenolic antioxidant, include 2,6-di-t-butyl-4-methylphenol, styrenized phenol, n-octadecyl-3-(3',5'-di-t-butyl-4'-hydroxyphenyl)propionate, 2,2'-methylene-bis(4-methyl-6-t-butylphenol), 2-t-butyl-6-(3'-t-butyl-5'-methyl-2'-hydroxybenzyl)-4-methylphenyl acrylate, 4,4'-butylidene-bis-(3-methyl-6-t-butylphenol), 4,4'-thio-bis-(3-methyl-6-t-butylphenol), 1,3,5-tris(4-t-butyl-3-hydroxy-2,6-dimethylbenzyl) isocyanurate, tetrakis-[methylene-3-(3',5'-di-t-butyl-4'-hydroxyphenyl)propionate]-methane, and 3,9-bis[2-[3-(3-t-butyl-4-hydroxy-5-methylphenyl)propionyloxy]1,1-dimethylethyl]-2,4,8,10-tetraoxaspiro[5,5]undecane.

Those of a hindered amine compound include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diimyl}{(2,2,6,6-tetramethyl-4-6-tetramethyl-4-piperidyl)imino}hexamethylene{(2,3,6,6-tetramethyl-4-piperidyl)imino)}], 2-(3,5-di-t-butyl-4-hydroxybenzyl)-2-n-butyl malonate bis(1,2,2,6,6-pentamethyl-4-piperidyl), and N,N'-bis(3-aminopropyl) ethylenediamine-2,4-bis[N-butyl-N-(1,2,2,6,6-pentamethyl-4-piperidyl)amino]-6-chloro-1,3,5-triazine condensate.

Examples of the organic sulfur-containing antioxidant include dilauryl-3,3'-thiodipropionate, dimyristyl-3,3'-thiodipropionate, distearyl-3,3'-thiodipropionate, pentaerythritol-tetrakis(β-lauryl-thiopropionate), ditridecyl-3,3'-thiodipropionate, and 2-mercaptobenzimidazole.

Also examples of the organic phosphor-containing antioxidant include trisnonylphenyl phosphite, triphenyl phosphite, and tris(2,4-di-t-butylphenyl)phosphite.

The organic sulfur-containing antioxidant or the organic phosphor-containing antioxidant is called a secondary antioxidant which can be used in combination with a primary antioxidant of a phenol type or an amine type to obtain a multiplying effect.

A photostabilizer can be derivatives of benzophenone, benzotriazole, dithiocarbamate, or tetramethylpiperidine.

Examples of the benzophenone-based photostabilizer include 2-hydroxy-4-methoxybenzophenone, 2-hydroxy-4-octoxybenzophenone, and 2,2'-di-hydroxy-4-methoxybenzophenone.

Examples of the benzotriazole-based photostabilizer include 2-(2'-hydroxy-5'-methylphenyl)-benzotriazole, 2-[2'-hydroxy-3'-(3",4",5",6"-tetra-hydrophthalimidemethyl)-5'-methylphenyl]-benzotriazole, 2-(2'-hydroxy-3'-t-butyl-5'-methylphenyl)-5-chlorobenzotriazole, 2-(2'-hydroxy-3',5'-di-t-butylphenyl)-benzotriazole, 2-(2'-hydroxy-5'-t-octylphenyl)-benzotriazole, and 2-(2'-hydroxy-3',5'-di-t-amylphenyl)-benzotriazole.

Other compounds include 2,4-di-t-butylphenyl-3',5'-di-t-butyl-4'-hydroxybenzoate and nickel dibutyl-dithiocarbamate.

Also at least an electron-accepting substance may be included for the purposes of improving the sensitivity, reducing the residual potential and reducing a fatigue in repeated uses.

Such electron accepting substance can be, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid or phthalic acid. Among these, particularly preferred are a fluorenone compound, a quinone compound and a benzene derivative having an electron attracting substituent such as Cl, CN or $NO_2$.

A overcoat layer 5 is used, in an electrophotographic photoreceptor of a laminar structure, for preventing a chemical change in the charge transport layer at charging, and for improving the mechanical strength of the photosensitive layer, thereby further improving resistances to abrasion and scratches of the surface layer.

The overcoat layer 5 can be formed as a resinous cured film containing a curable resin and a charge transporting compound, or a film constituted by including a conductive material in a suitable binder resin, but one containing a charge transport compound is employed more preferably.

The curable resin may be any known resin, but a resin having a crosslinked structure is preferable in consideration of the strength, the electrical characteristics and the constancy of image quality, such as a phenolic resin, an urethane resin, a melamine resin, a diallyl phthalate resin or a siloxane resin.

Among them, a overcoat layer 5 containing a siloxane resin having a structural unit having a charge-transporting potential and a cross-linking structure is more preferable.

The overcoat layer 5 is preferably a cured film including a compound represented by a following formula (I-1) or (I-2):

$$F\text{-}[D\text{-}Si(R^2)_{(3-a)}Q_a]_b \qquad \text{Formula (I-1)}$$

wherein, in the formula (I-1), F represents an organic group derived from a photofunctional compound; D represents a flexible subunit; $R^2$ represents a hydrogen atom, an alkyl group or a substituted or unsubstituted aryl group; Q represents a hydrolyzable group; a represents an integer of 1-3; and b represents an integer of 1-4;

$$F\text{—}((X)_nR^1\text{—}ZH)_m \qquad \text{Formula (I-2)}$$

wherein, in the formula (I-2), F represents an organic group derived from a photofunctional compound; $R^1$ represents an alkylene group; Z represents an oxygen atom, a sulfur atom, NH, $CO_2$ or COOH; m represents an integer of 1-4; X represents an oxygen atom or a sulfur atom; and n represents 0 or 1.

In the formulas (I-1) and (I-2), F represents a unit having a photoelectric property more specifically a photocarrier transporting property, and a structure already known as the charge transport material can be applied. More specifically, there can be utilized a skeleton of a compound having a hole transporting property, such as a triarylamine compound, a benzidine compound, an arylalkane compound, an aryl-substituted ethylene compound, a stilbene compound, an anthracene compound, or a hydrazone compound, and a skeleton of a compound having an electron transporting property, such as a quinone compound, a fluorenone compound, a xanthone compound, a benzophenone compound, a cyanovinyl compound, or an ethylene compound.

In the formula (I-1), $—Si(R^2)_{(3-a)}Q_n$ represents a substituted silicon group having a hydrolysable group, in which the substituted silicon atom causes a mutual crosslinking reaction with a Si group, thereby forming a three-dimensional Si—O—Si bond. Thus, the substituted silicon group serves to form so-called inorganic glass-like network in the protective layer 5.

In the formula (I-1), D represents a flexible subunit, more specifically an organic group serving to connect an F portion for realizing a photoelectric property with a substituted silicon group which is directly connected with the three-dimensional inorganic glass-like network and providing the inorganic glass-like network which is hard but brittle with an adequate flexibility and improving the tenacity of the film.

The unit D can be, more specifically, a divalent hydrocarbon group represented by $—C_nH_{2n}—$, $—C_nH_{(2n-2)}—$ or $—C_nH_{(2n-4)}—$ (wherein n represents an integer of 1-15), —COO—, —S—, —O—, $—CH_2—C_6H_4—$, —N═CH—, $—(C_6H_4)—(C_6H_4)—$, a characteristic group formed by arbitrarily combining these groups, or such characteristic group in which a structural atom is substituted by another substituent.

In the formula (I-1), b is preferably 2 or larger. In case b is 2 or larger, the photofunctional organic silicon compound represented by the general formula (I-1) contains two or more Si atoms, thus becoming easier to form an inorganic glass-like network and increasing the mechanical strength thereof.

Among the formulas (I-1) and (I-2), a compound in which the organic group F is represented by a following formula (I-3) is particularly preferable. A compound represented by the formula (I-3) is a compound having a hole transporting property (hole transport material), and the presence of such compound in the overcoat layer 5 is preferable in terms of improvement in the photoelectric properties and the mechanical properties of the overcoat layer 5.

Formula (I-3)

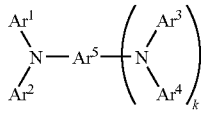

In the formula (I-3), $Ar^1$ to $Ar^4$ each independently represents a substituted or non-substituted aryl group; $Ar^5$ represents a substituted or non-substituted aryl group or an arylene group, wherein two to four among $Ar^1$ to $Ar^5$ have a bonding hand represented by $-D-Si(R^2)_{(3-a)}Q_n$; D represents a flexible subunit; $R^2$ represents a hydrogen atom, an alkyl group, or a substituted or non-substituted aryl group; Q represents a hydrolysable group; and a represents an integer of 1-3.

In the formula (I-3), $Ar^1$ to $Ar^5$ are preferably represented by following formulas (I-4) to (I-10).

TABLE 1

| | |
|---|---|
| (I-4) | 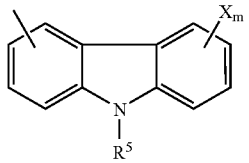 |
| (I-5) | 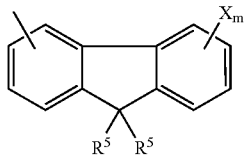 |
| (I-6) | 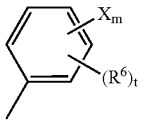 |
| (I-7) | 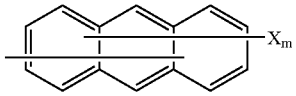 |
| (I-8) | 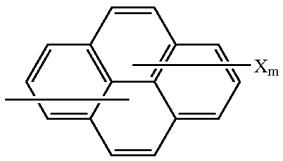 |
| (I-9) | 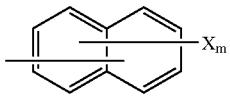 |
| (I-10) | $—Ar—(Z')_s—Ar—X_m$ |

In the formulas (I-4) to (I-10), $R^5$ each independently represents a group selected from a hydrogen atom, an alkyl group with 1 to 4 carbon atoms, a phenyl group substituted with an alkyl group with 1 to 4 carbon atoms or an alkoxy group with 1 to 4 carbon atoms, a non-substituted phenyl group, and an aralkyl group with 7 to 10 carbon atoms; $R^6$ represents a group selected from a hydrogen atom, an alkyl group with 1 to 4 carbon atoms, an alkoxy group with 1 to 4 carbon atoms, and a halogen atom; X represents a characteristic group of a structure represented by $-D-Si(R^2)_{(3-a)}Q_n$ or $—((X)_nR^1—ZH)_m$ described above; m and s each represents 0 or 1; and t represents an integer of 1-3.

Throughout the specification, if there two or more groups represented by the same sign, any two of the groups may be the same as each other or different from each other. Throughout the specification, if there two or more numbers represented by the same sign, any two of the numbers may be the same as each other or different from each other.

In the formula (I-10), Ar is preferably represented by following formulas (I-11) to (I-12).

TABLE 2

| | |
|---|---|
| (I-11) | 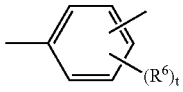 |

TABLE 2-continued

| | |
|---|---|
| (I-12) | 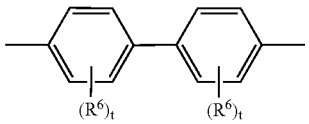 |

In the formulas (I-11) and (I-12), $R^6$ has the same meaning as $R^6$ mentioned before; and t represents an integer of 1-3.

In the formula (I-10), Z' is preferably represented by following formulas (I-13) to (I-14).

Also in the formulas (I-4) to (I-10), X represents a characteristic group of a structure represented by $-D-Si(R^2)_{(3-a)}Q_a$ as described before. In such characteristic group, D represents divalent hydrocarbon group represented by $—C_1H_{21}—$, $—C_mH_{(2m-2)}—$ or $—C_nH_{(2n-4)}—$ (wherein 1 represents an integer of 1-15, m represents an integer of 2-15 and n represents an integer of 3-15), —N=CH—, —O—, —COO—, —S—, $—(CH)_\beta—$ (β representing an integer of 1-10), or a characteristic group represented by the aforementioned general formula (I-11) or (I-12) or following formulas (I-13) and (I-14).

TABLE 3

| | |
|---|---|
| (I-13) | 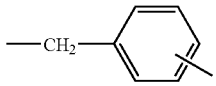 |
| (I-14) | 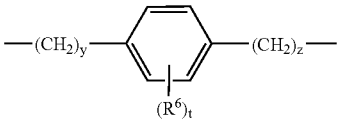 |

In the formula (I-14), y and z each represents an integer of 1-5; t represents an integer of 1-3; and $R^6$ represents, as described before, one selected from a group of a hydrogen atom, an alkyl group with 1 to 4 carbon atoms, an alkoxy group with 1 to 4 carbon atoms, and a halogen atom.

In the formula (I-3), $Ar^5$ represents a substituted or non-substituted aryl or arylene group, and, in case of k=0, there is preferred a group corresponding to any of formulas (I-15) to (I-19) shown in Table 4, and, in case of k=1, there is preferred a group corresponding to any of formulas (I-20) to (I-24) shown in Table 5.

TABLE 4

| | |
|---|---|
| (I-15) | 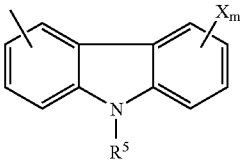 |
| (I-16) | 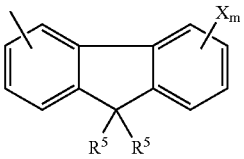 |

TABLE 4-continued

| | |
|---|---|
| (I-17) | 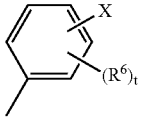 |
| (I-18) | 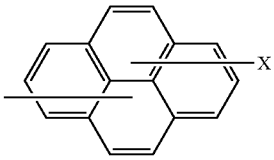 |
| (I-19) | $—Ar—(Z)_s—Ar—X$ |

TABLE 5

| | |
|---|---|
| (I-20) | 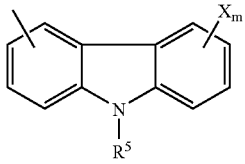 |
| (I-21) | 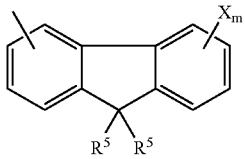 |
| (I-22) | 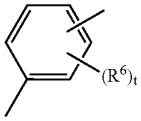 |
| (I-23) | 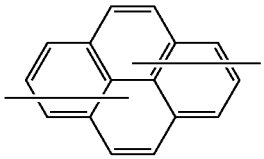 |
| (I-24) | $—Ar—(Z)_s—Ar—$ |

In Formulae (I-15) to (I-24), each $R^5$ independently represents an atom or a group selected from the group consisting of a hydrogen atom, alkyl groups having 1 to 4 carbons, phenyl groups substituted with an alkyl groups having 1 to 4 carbons or an alkoxy group having 1 to 4 carbons, unsubstituted phenyl groups, and aralkyl groups having 7 to 10 carbons. $R^6$ represents an atom or a group selected from the group consisting of a hydrogen atom, alkyl groups having 1 to 4 carbons, alkoxy groups having 1 to 4 carbons, and halogen atoms. s is 0 or 1; and t is an integer of 1 to 3.

Also in case $Ar^5$ in the formula (I-3) assumes any of the structures shown by the formulas (I-15) to (I-19) in Table 4 and the formulas (I-20) to (I-24) in Table 5, Z' in formulas (I-19) and (I-24) is preferably one selected from a group of following formulas (I-25) to (I-32).

TABLE 6

| | |
|---|---|
| (I-25) | $—(CH_2)_q—$ |
| (I-26) | $—(CH_2CH_2O)_r—$ |
| (I-27) | |
| (I-28) | |
| (I-29) | |
| (I-30) | |
| (I-31) | |
| (I-32) | |

In the formulas (I-31) and (I-32), $R^7$ each represents one selected from a group of a hydrogen atom, an alkyl group with 1 to 4 carbon atoms, an alkoxy group with 1 to 4 carbon atoms and a halogen atom; W represents a divalent group; q and r each represents an integer of 1-10; and t' represents an integer of 1-2.

In the formulas (I-31) and (I-32), W is preferably any one of divalent groups represented by following formulas (I-33) to (I-41). In the formula (I-40), s' represents an integer of 0-3.

$—CH_2—$ (I-33)

$—C(CH_3)_2—$ (I-34)

—O— (I-35)

—S— (I-36)

$—C(CF_3)_2—$ (I-37)

$—Si(CH_3)_2—$ (I-38)

TABLE 7

| | |
|---|---|
| (I-39) | |
| (I-40) | |

TABLE 7-continued

| | |
|---|---|
| (I-41) | |

Also specific examples of the compound represented by the formula (I-3) are given in JP-A No. 2001-83728, by compounds Nos. 1-274 shown in tables 1-55.

The charge transport compound represented by the general formula (I-1) may be employed singly or in a combination of two or more kinds.

In combination with the charge transport compound represented by the formula (I-1), for the purpose of further improving the mechanical strength of the cured film, a compound represented by a following formula (II) may be employed.

$$B—(Si(R^2)_{(3-n)}Q_n)_2 \quad \text{Formula (II)}$$

In the formula (II), B represents a divalent organic group; $R^2$ represents a hydrogen atom, an alkyl group or a substituted or non-substituted aryl group; Q represents a hydrolysable group; and a represents an integer of 1-3.

The compound represented by the formula (II) is preferably one represented by following formulas (II-1) to (II-5), but the present invention is not limited to such structures.

In the formulas (II-1) to (II-5), T1 and T2 each independently represents a divalent or trivalent hydrocarbon group that may be branched; A represents a substituted silicon group having a hydrolysable property as explained before; h, i and j each independently represents an integer of 1-3. The compound represented by the formulas (II-1) to (II-5) is so selected that a number of A in the molecule is 2 or more.

TABLE 8

| | |
|---|---|
| (II-1) | $T^1$—[A]$_j$ |
| (II-2) | |
| (II-3) | |
| (II-4) | HN—[$T^1$—A]$_2$ |
| (II-5) | |

In the following, preferred specific examples of the compound represented by the formula (II) are shown by following formulas (III-1) to (III-19) in Tables 9 and 10. In Tables 9 and 10, Me, Et and Pr respectively represent a methyl group, an ethyl group and a propyl group.

TABLE 9

| | |
|---|---|
| (III-1) | |

TABLE 9-continued

| | |
|---|---|
| (III-2) | $(EtO)_3Si$ — $Si(OEt)_3$ |
| (III-3) | $(i\text{-}Pr—O)_3Si$ — $Si(O—i\text{-}Pr)_3$ |
| (III-4) | $(MeO)_3Si$ — $Si(OMe)_3$ |
| (III-5) | $(EtO)_3Si$ — $Si(OEt)_3$ |
| (III-6) | $(i\text{-}Pr—O)_3Si$ — $Si(O—i\text{-}Pr)_3$ |
| (III-7) | $(MeO)_3Si$ — $Si(OMe)_3$ |
| (III-8) | $(EtO)_3Si$ — $Si(OEt)_3$ |
| (III-9) | $(MeO)_3Si$ — $Si(OMe)_3$ |
| (III-10) | $(EtO)_3Si$ — $Si(OEt)_3$ |
| (III-11) | $(MeO)_3Si$ — $\overset{H}{N}$ — $Si(OMe)_3$ |
| (III-12) | $(MeO)_3Si$ — $\overset{H}{N}$ — $\underset{H}{N}$ — $Si(OMe)_3$ |

TABLE 10

| | | | |
|---|---|---|---|
| (III-13) | $(MeO)_2MeSi(CH_2)_2SiMe(OMo)_2$ | (III-14) | $(EtO)_2EtSi(CH_2)_2SiEt(OEt)_2$ |
| (III-15) | $(MeO)_2MeSi(CH_2)_6SiMe(OMe)_2$ | (III-16) | $(EtO)_2EtSi(CH_2)_6SiEt(OEt)_2$ |
| (III-17) | $(MeO)_2MeSi(CH_2)_{10}SiMe(OMe)_2$ | (III-18) | $(EtO)_2EtSi(CH_2)_{10}SiEt(OEt)_2$ |
| (III-19) | $MeOMc_2Si(CH_2)_GSiMe_2OMe$ | | |

Another compound capable of a crosslinking reaction may be employed in combination with the compound represented by the formula (I-1) or (I-2). Such compound can be a silane coupling agent, or a commercially available silicone hard coating agent.

The silane coupling agent can be vinyltrichlorosilane, vinyltrimethoxysilane, vinyltriethoxysilane, γ-glycidoxypropylmethyl diethoxysilane, γ-glycidoxypropyl triethoxysilane, γ-glycidoxypropyl trimethoxysilane, γ-aminopropyl triethoxysilane, γ-aminopropyl trimethoxysilane, γ-aminopropylmethyl dimethoxysilane, N-β(aminoethyl)γ-aminopropyl triethoxysilane, tetramethoxysilane, methyldimethoxysilane, or dimethyldimethoxysilane.

The commercially available hard coating agent can be KP-85, CR-39, X-12-2208, X-40-9740, X-41-1007, KNS-5300, X-40-2239 (manufactured by Shin-etsu Chemical Co.), AY42-440, AY42-441 and AY49-208 (manufactured by Dow Corning Toray Silicone Co.).

In the overcoat layer 5, a fluorine atom-containing compound may be added for the purpose of providing a surface lubricating property. An increase in the surface lubricating property can reduce a friction coefficient with a cleaning member and can improve the abrasion resistance. It may also have an effect of preventing deposition of a discharge product, a developer and paper dusts onto the surface of the electrophotographic photoreceptor, thereby extending the service life thereof.

As specific examples of the fluorine-containing compound, it is possible to add a fluorine atom-containing polymer such as polytetrafluoroethylene directly, or to add fine particles of such polymer.

In case the overcoat layer 5 is a cured film formed by the compound represented by the formula (I), it is preferable to add a fluorine-containing compound capable of reacting with alkoxysilane thereby constituting a part of the crosslinked film.

Specific examples of such fluorine atom-containing compound include (tridecafluoro-1,1,2,2-tetrahydrooctyl) triethoxysilane, (3,3,3-trifluoropropyl)trimethoxysilane, 3-(heptafluoroisopropoxy)propyl triethoxysilane, 1H,1H,2H,2H-perfluoroalkyl triethoxysilane, 1H, 1H,2H,2H-perfluorodecyl triethoxysilane, and 1H, 1H,2H,2H-perfluorooctyl triethoxysilane.

An amount of addition of the fluorine-containing compound is preferably 20 weight % or less. An exceeding amount may cause a defect in the film forming property of the crosslinked cured film.

The aforementioned overcoat layer 5 has a sufficient antioxidation property, but an antioxidant may be added in order to obtain an even stronger antioxidation property.

The antioxidant is preferably a hindered phenol type or a hindered amine type, but it is also possible to employ a known antioxidant such as an organic sulfur-based antioxidant, a phosphite antioxidant, a dithiocarbamate antioxidant, a thiourea antioxidant, or an benzimidazole antioxidant. An amount of addition of the antioxidant is preferably 15 weight % or less, more preferably 10 weight % or less.

Examples of the hindered phenol type antioxidant include 2,6-di-t-butyl-4-methylphenol, 2,5-di-t-butylhydroquinone, N,N'-hexamethylenebis(3,5-di-t-butyl-4-hydroxyhydrocinnamide), 3,5-di-t-butyl-4-hydroxy-benzyl phosphonate diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenyl), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

In the overcoat layer 5, other known additives employed in film formation may be added, such as a leveling agent, an ultraviolet absorber, a photostabilizer, a surfactant and the like.

The overcoat layer 5 is formed by coating a mixture of the aforementioned materials and other additives on the photosensitive layer, followed by heating. In this manner a three-dimensional crosslinking curing reaction is induced to form a firm cured film. The heating may be executed at any temperature not influencing the underlying photosensitive layer, but is preferably executed within a range from room temperature to 200° C., particularly from 100° C. to 160° C.

In forming the overcoat layer 5, the crosslinking curing reaction may be executed without a catalyst or with a suitable catalyst. The catalyst can be an acid catalyst such as hydrochloric acid, sulfuric acid, phosphoric acid, formic acid, acetic acid or trifluoroacetic acid; a base such as ammonia or triethylamine; an organic tin compound such as dibutyl tin diacetate, dibutyl tin dioctoate or stannous octoate; an organic titanium compound such as tetra-n-butyl titanate or tetraisopropyl titanate; or an iron salt, a manganese salt, a cobalt salt, a zinc salt, a zirconium salt or an aluminum chelate compound of an organic carboxylic acid.

In the overcoat layer 5, a solvent may be added, if necessary, in order to facilitate coating. More specifically there can be employed water or an ordinary organic solvent such as methanol, ethanol, n-propanol, i-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, dimethyl ether or dibutyl ether. Such solvent may be employed singly or in a mixture of two or more kinds.

In forming the overcoat layer 5, the coating can be executed by an ordinary coating method such as blade coating, Meyer bar coating, spray coating, dip coating, bead coating, air knife coating, or curtain coating.

The overcoat layer 5 has a thickness of 0.5 to 20 μm, preferably 2 to 10 μm.

In the electrophotographic photoreceptor 7, functional layers including the charge generation layer 31 and above have a thickness, for obtaining a high resolution, of 50 μm or less, preferably 40 μm or less. When the functional layers are thin, the combination of the particle-dispersed undercoat layer and the highly strong overcoat layer 5 of the invention becomes particularly effective.

The electrophotographic photoreceptor 7 is not limited to the aforementioned structure. For example, the electrophotographic photoreceptor 7 may be constructed without the intermediate layer 4 and/or the overcoat layer 5. More specifically, there can be adopted a structure having an undercoat layer 2 and a photosensitive layer 3 on a conductive substrate 1, a structure having an undercoat layer 2, an intermediate layer 4 and a photosensitive layer 3 in succession on a conductive substrate 1, or a structure having an undercoat layer 2, a photosensitive layer 3 and a overcoat layer 5 in succession on a conductive substrate 1

Also the charge generation layer 31 and the charge transport layer 32 may be laminated in an inverted order. Also the photosensitive layer 3 may have a single-layer structure. In such case, the photosensitive layer may be provided thereon with a overcoat layer, or provided with both an undercoat layer and a overcoat layer. Also an intermediate layer may be provided, as explained in the foregoing, on the undercoat layer.

(Electrophotographic Apparatus)

FIG. 2 is a schematic view showing a preferable embodiment of an electrophotographic apparatus of the present invention. An electrophotographic apparatus 100 shown in FIG. 2 is provided with a drum-shaped (cylindrical) electrophotographic photoreceptor 7 of the invention, provided in a rotatable manner. Around the electrophotographic photoreceptor 7, there are provided, along a moving direction of an external periphery thereof, a charging apparatus 8, an exposure apparatus 10, a developing apparatus 11, a transfer apparatus 12, a cleaning apparatus 13 and a charge eliminator (erasing apparatus) 14.

A charging apparatus 8 of a corona charging type is used for charging the electrophotographic photoreceptor 7. The charging apparatus 8 may be constituted of a corotron charger or a scorotron charger. The charging apparatus 8 is connected to a power source 9.

An exposure apparatus 10 exposes the charged electrophotographic photoreceptor 7 to a light, thereby forming an electrostatic latent image thereon.

A developing apparatus 11 develops the electrostatic latent image with a developer to form a toner image. The developer preferably includes toner particles of a volume average particle size of 3 to 9 μm obtained by a polymerization method.

A transfer apparatus 12 transfers the toner image, developed on the electrophotographic photoreceptor 7, onto a transfer medium.

A cleaning apparatus 13 removes a toner remaining on the electrophotographic photoreceptor 7 after the transfer. The cleaning apparatus 13 preferably has a blade member maintained in contact with the electrophotographic photoreceptor 7 under a linear pressure of 10-150 g/cm.

A charge eliminator (erasing apparatus) 14 erases a retentive charge on the electrophotographic photoreceptor 7. The electrophotographic apparatus 100 is provided with a fixing apparatus 15 for fixing, after the transfer step, the toner image to the transfer medium.

Figure 3:
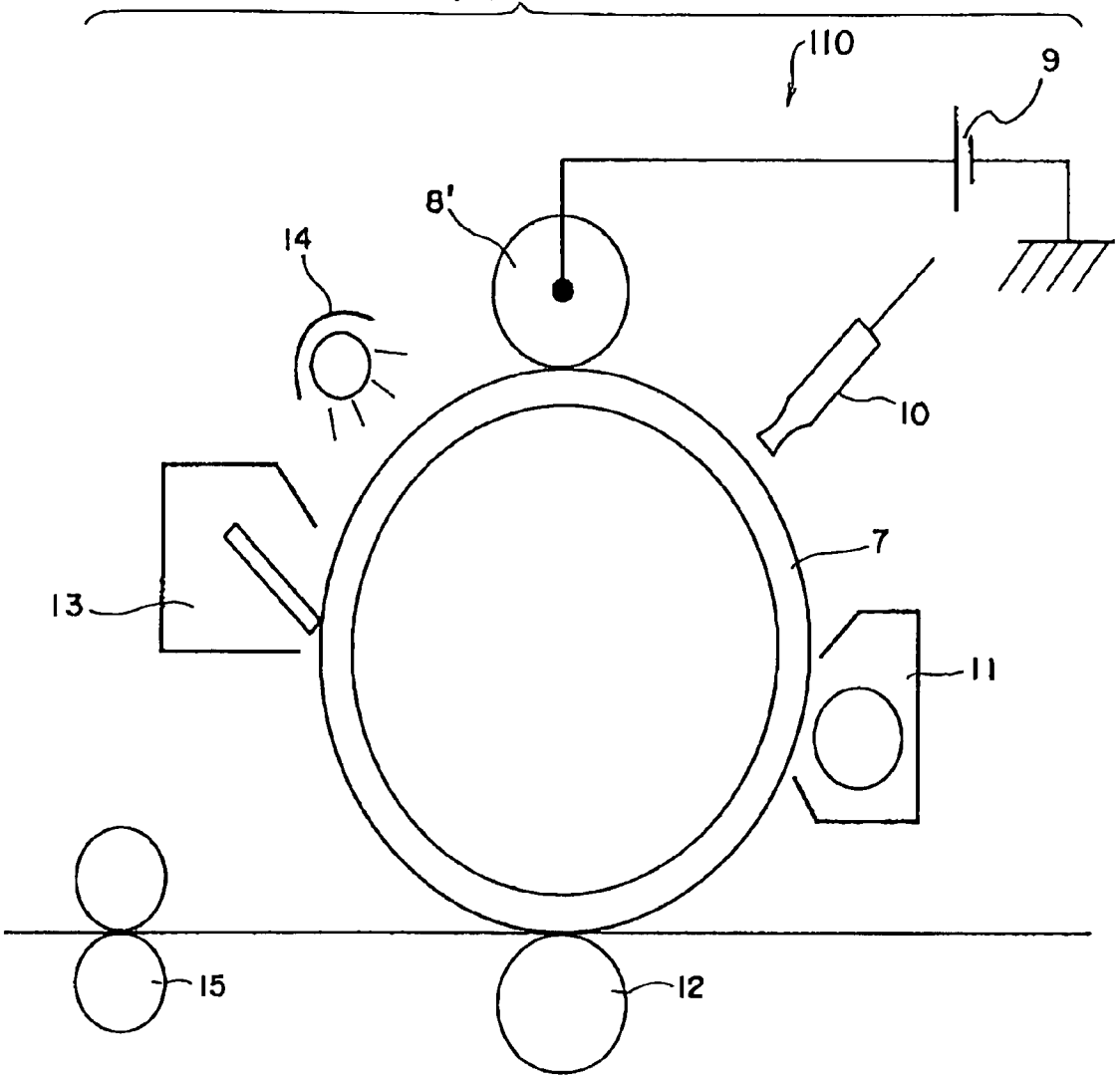
FIG. 3 is a schematic view illustrating another favorable embodiment of the electrophotographic apparatus according to the invention.

FIG. 3 is a schematic view showing another preferred embodiment of the electrophotographic apparatus of the invention. An electrophotographic apparatus 110 shown in FIG. 3 is similar, in structure, to the electrophotographic apparatus 100 shown in FIG. 2, except that it is equipped with a charging apparatus 8' for charging the electrophotographic photoreceptor 7 in a contact method. In the electrophotographic apparatus 110 with a contact charging apparatus utilizing a DC voltage superposed with an AC voltage, the electrophotographic photoreceptor 7 can be advantageously employed because of an excellent leak resistance. In this case, the charge eliminator 14 may not be equipped.

In the contact charging method, a charging member of a roller shape, a blade shape, a belt shape, a brush shape or a magnetic brush shape can be utilized. Particularly in case of a roller-shaped or blade-shaped charging member, such charging member may be positioned, with respect to the photoreceptor, in a contact state or in a non-contact state with a certain gap (100 μm or less) thereto.

A roller-shaped, blade-shaped or belt-shaped charging member is constituted of a material regulated to an electrical resistance ($10^3$-$10^8\Omega$) suitable for a charging member, and may be constituted of a single layer or plural layers.

It can be formed of an elastomer constituted of a synthetic rubber such as urethane rubber, silicone rubber, fluorinated rubber, chloroprene rubber, butadiene rubber, EPDM or epichlorohydrin rubber, or of polyolefin, polystyrene or polyvinyl chloride, blended with an appropriate amount of a conductivity providing material such as conductive carbon, a metal oxide or an ionic conductive material thereby exhibiting an effective electroconductivity as a charging member.

It is also possible to prepare a paint of a resin such as nylon, polyester, polystyrene, polyurethane or silicone, blending therein an appropriate amount of a conductivity providing material such as conductive carbon, a metal oxide or an ionic conductive material and laminating thus obtained paint by an arbitrary method such as a dip, a spraying or a roll coating.

On the other hand, a brush-shaped charging member can be prepared by subjecting already known fibers of acrylic resin, nylon or polyester, rendered electroconductive, to a fluorine impregnating process and then planting such fibers in an already known method. The fluorine impregnating process may be executed after the fibers are formed into a brush-shaped charging member.

The brush-shaped charging member herein includes a roller-shaped member and a charging member having fibers planted on a flat plate, and is not limited to a particular shape. Also a magnetic brush-shaped charging member includes ferrite or magnetite, showing a magnetic power, arranged radially on an external periphery or a cylinder incorporating a multi-pole magnet, and the ferrite or magnetite is preferably subjected to a fluorine impregnating process prior to the formation into a magnetic brush.

Figure 4:
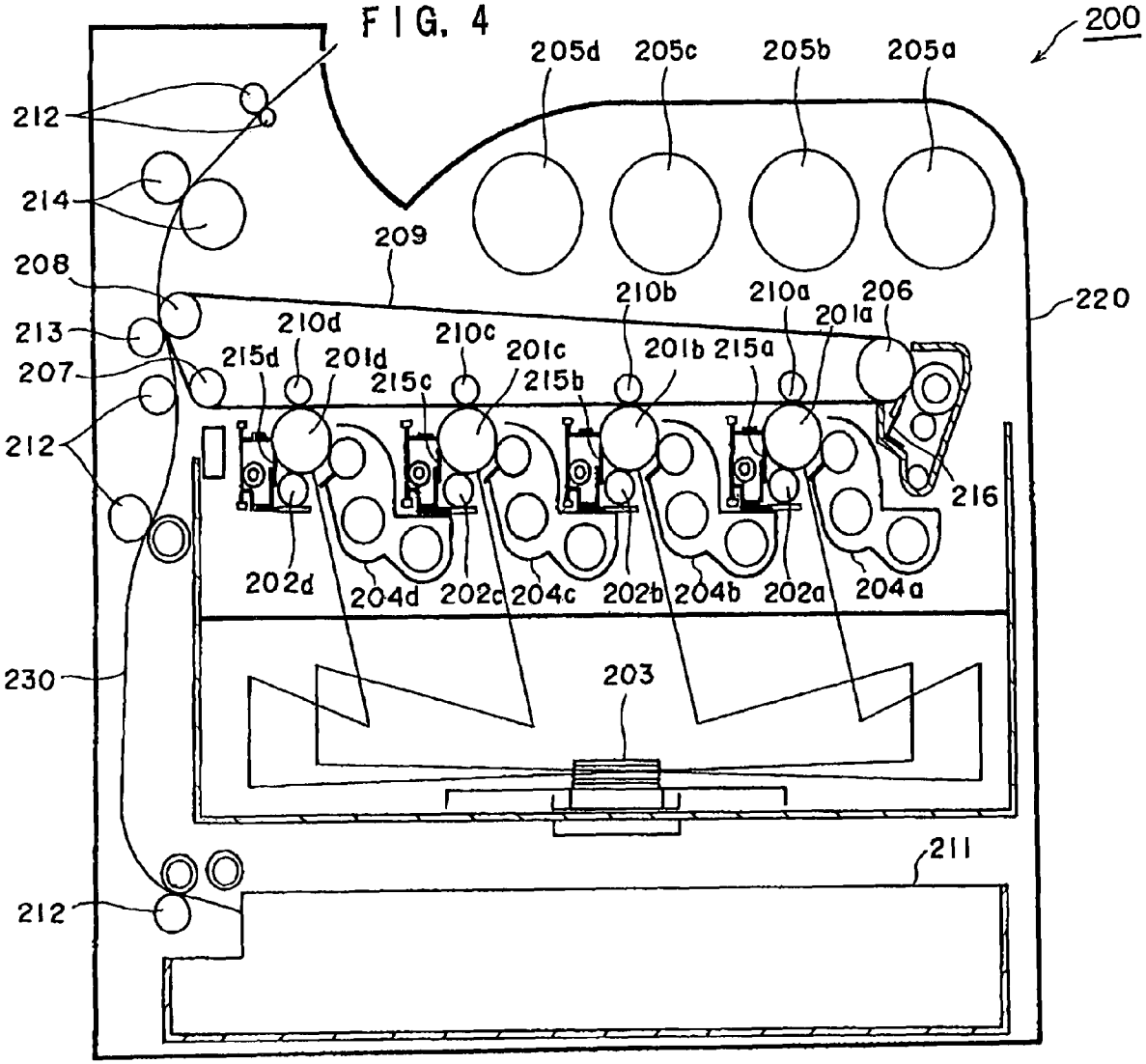
FIG. 4 is a schematic view illustrating yet another favorable embodiment of the electrophotographic apparatus according to the invention.

FIG. 4 is a schematic view showing another preferred embodiment of the electrophotographic apparatus of the invention. An electrophotographic apparatus 200 is of a tandem type with intermediate transfer method. In an housing 220, four electrophotographic photoreceptors 201*a*-201*d* (for example 201*a* for yellow color, 201*b* for magenta color, 201*c* for cyan color and 201*d* for black color image formation) are arranged mutually parallel and along an intermediate transfer belt 209.

For transferring a visible image onto a transfer sheet such as paper, a transfer drum method is already known in which the transfer sheet such as paper is wound on a transfer drum and visible images of respective colors on the photoreceptor are transferred onto such transfer sheet. In this case, an transfer drum has to be rotated plural turns for transferring the visible images from the photoreceptors to the transfer sheet, but, in the tandem intermediate transfer method, the transfer from plural photoreceptors 201*a*-201*d* can be achieved in a single turn of the intermediate transfer member 209. This transfer method is promising hereafter because of a higher transfer speed thus achieved and an advantage that the transfer medium need not be selective as in the case of the transfer drum method.

The electrophotographic photoreceptors 201*a*-201*d* mounted in the electrophotographic apparatus 200 are respectively similar to the electrophotographic photoreceptor 7.

The electrophotographic photoreceptors 201*a*-201*d* are respectively rotated in a predetermined direction (counterclockwise in the illustration), and, charging rollers 202*a*-202*d*, developing apparatuses 204*a*-204*d*, primary transfer rollers 210*a*-210*d*, and cleaning apparatuses 215*a*-215*d* are arranged along the direction of rotation. Toners of four colors of yellow, magenta, cyan and black, respectively contained in toner cartridges 205*a*-205*d*, can be respectively supplied to the developing apparatuses 204*a*-204*d*. Also the primary transfer rollers 210*a*-210*d* are respectively in contact with the electrophotographic photoreceptors 201*a*-201*d* across the intermediate transfer belt 209.

In a predetermined position of the housing 220, a laser light source (exposure apparatus) 203 is positioned. A laser light emitted from the laser light source 203 is so guided to irradiate the surfaces of the electrophotographic photoreceptors 201*a*-201*d* after the charging, whereby steps of charging, exposure, development, primary transfer and cleaning are executed in succession in the course of rotation of the electrophotographic photoreceptors 201*a*-201*d*, and toner images of the respective colors are transferred in superposition onto the intermediate transfer belt 209.

The intermediate transfer belt 209 is supported under a predetermined tension by a driving roller 206, a backup roller 208 and a tension roller 207, and is rendered rotatable without slack by the rotation of these rollers. A secondary transfer roller 213 is so positioned as to contact the backup roller 208 across the intermediate transfer belt 209.

The intermediate transfer belt 209, after passing between the backup roller 208 and the secondary transfer roller 213, is subjected to a surface cleaning by a cleaning blade 216 positioned for example in the vicinity of the driving roller 206 and is then used again for a next image formation process.

A tray (transfer medium tray) 211 is provided in a predetermined position within the housing 220, and a transfer medium 230 such as paper contained in the tray 211 is transferred, by a transfer roller 212, in a path between the intermediate transfer belt 209 and the secondary transfer roller 213 and also between mutually contacting two fixing rollers 214, and is then discharged to the exterior of the housing 220.

In the foregoing, there has been explained a case in which the intermediate transfer belt 209 is employed as an intermediate transfer member, but the intermediate transfer member may be constructed as a belt shape (for example as an endless belt) as in the case of the intermediate transfer belt 209 or as a drum shape. In case of employing a belt-shaped structure such as the intermediate transfer belt 209 as the intermediate transfer member, such belt preferably has a thickness of 50 to 500 μm more preferably 60 to 150 μm. The thickness of the belt can be suitably selected according the hardness of the material. Also in case of employing a drum-shaped structure as the intermediate transfer member, a substrate is preferably constituted of a cylindrical substrate formed for example of aluminum, stainless steel (SUS) or copper. On such cylindrical substrate, an elastic layer may be provided if necessary, and a surface layer can be formed on such elastic layer.

The transfer medium mentioned in the invention may be any medium to which a toner image formed on the electrophotographic photoreceptor is transferred. For example, in case of direct transfer from the electrophotographic photoreceptor to a paper or the like, such paper or the like constitutes the transfer medium, and, in case of employing an intermediate transfer member, such intermediate transfer member constitutes the transfer medium.

As the material constituting the aforementioned endless belt, there is proposed a semiconductive endless belt of a thermoplastic material such as a polycarbonate resin (PC), a polyvinylidene fluoride (PVDF), polyalkylene phthalate, a PC/polyalkylene phthalate (PAT) blend, or an ethylene-tetrafluoroethylene copolymer (ETFE).

Also Japanese Patent No. 2560727 and JP-A No. 5-77252 propose an intermediate transfer member in which ordinary carbon black is dispersed as conductive powder in a polyimide resin.

There can be obtained an intermediate transfer member not easily causing an image defect such as a color aberration, since the polyimide resin, having a high Young's modulus, shows little deformation at the driving (under stresses from the supporting roller, cleaning blade and the like). The polyimide resin is usually obtained as a polyamide acid solution by a polymerization reaction of a tetracarboxylic acid dianhydride or a derivative thereof and a diamine in approximately equimolar amounts in solvent. The tetracarboxylic acid dianhydride is, for example, represented by a following formula (IV):

(IV)

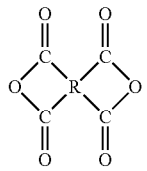

In the formula (IV), R represents a tetravalent organic group selected from a group of an aliphatic linear hydrocarbon group, an alicyclic hydrocarbon group, an aromatic hydrocarbon group, and such hydrocarbon group to which a substituent is bonded.

Specific examples of tetracarboxylic acid dianhydride include pyromellitic acid dianhydride, 3,3',4,4'-benzophenonetetracarboxylic acid dianhydride, 3,3',4,4'-biphenyltetracarboxylic acid dianhydride, 2,3,3',4-biphenyltetracarboxylic acid dianhydride, 2,3,6,7-naphthalenetetracarboxylic acid dianhydride, 1,2,5,6-naphthalenetetracarboxylic acid dianhydride, 1,4,5,8-naphthalenetetracarboxylic acid dianhydride, 2,2'-bis(3,4-dicarboxyphenyl)sulfonic acid dianhydride, perylene-3,4,9,10-tetracarboxylic acid dianhydride, bis(3,4-dicarboxyphenyl)ether dianhydride, and ethylenetetracarboxylic acid dianhydride.

On the other hand, specific examples of diamine include 4,4'-diaminodiphenyl ether, 4,4'-diaminodiphenylmethane, 3,3'-diaminodiphenylmethane, 3,3'-dichlorobenzidine, 4,4'-diaminodiphenylsulfide, 3,3'-diaminodiphenylsulfon, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenylsulfon, 4,4'-diaminodiphenylsulfon, 4,4'-diaminodiphenylpropane, 2,4-bis(β-amino-tert-butyl) toluene, bis(p-β-amino-tert-butylphenyl)ether, bis(p-β-methyl-δ-aminophenyl)benzene, bis-p-(1,1-dimethyl-5-aminopentyl)benzene, 1-isopropyl-2,4-m-phenylenediamine, m-xylilenediamine, p-xylilenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl] propane, piperadine, $H_2N(CH_2)_{30}(CH_2)_{20}(CH_2)NH_2$, $H_2N(CH_2)_3S(CH_2)_3NH_2$, and $H_2N(CH_2)_3N(CH_3)_2(CH_2)_3NH_2$.

A solvent to be used in the polymerization reaction of the tetracarboxylic acid dianhydride and the diamine is advantageously a polar solvent in consideration of solubility and the like. The polar solvent is preferably an N,N-dialkylamide, and more specifically of a lower molecular weight, such as N,N-dimethylformamide, N,N-dimethylacetamide, N,N-diethylformamide, N,N-diethylacetamide, N,N-dimethylmethoxyacetamide, dimethylsulfoxide, hexamethylphosphonyltriamide, N-methyl-2-pyrrolidone, pyridine, tetramethylenesulfone and dimethyltetramethylenesulfone. Such solvent may be employed singly or in a combination of two or more kinds.

The intermediate transfer member contains oxidation-processed carbon black in a polyimide resin. The oxidation-processed carbon black can be obtained by an oxidation process of carbon black thereby providing the surface thereof with an oxygen-containing functional group (such as a carboxyl group, a quinone group, a lactone group or a hydroxyl group).

Such oxidation process can be achieved for example by an air oxidation method of contacting and reacting with the air in a high-temperature environment, a method of contacting with a nitrogen oxide or ozone at the normal temperature, or a method of ozone oxidation at a low temperature after an air oxidation at a high temperature.

Examples of oxidized carbon include products of Mitsubishi Chemical Corp. such as MA100 (pH 3.5, volatiles 1.5%), MA100R (pH 3.5, volatiles 1.5%), MA100S (pH 3.5, volatiles 1.5%), #970 (pH 3.5, volatiles 3.0%), MA11 (pH 3.5, volatiles 2.0%), #1000 (pH 3.5, volatiles 3.0%), #2200 (pH 3.5, volatiles 3.5%), MA230 (pH 3.0, volatiles 1.5%), MA220 (pH 3.0, volatiles 1.0%), #2650 (pH 3.0, volatiles 8.0%), MA7 (pH 3.0, volatiles 3.0%), MA8 (pH 3.0, volatiles 3.0%), OIL7B (pH 3.0, volatiles 6.0%), MA77 (pH 2.5, volatiles 3.0%), #2350 (pH 2.5, volatiles 7.5%), #2700 (pH 2.5, volatiles 10.0%), and #2400 (pH 2.5, volatiles 9.0%); those of Degussa AG such as Printex 150T (pH 4.5, volatiles 10.0%), Special Black 350 (pH 3.5, volatiles 2.2%), Special Black 100 (pH 3.3, volatiles 2.2%), Special Black 250 (pH 3.1, volatiles 2.0%), Special Black 5 (pH 3.0, volatiles 15.0%), Special Black 4 (pH 3.0, volatiles 14.0%), Special Black 4A (pH 3.0, volatiles 14.0%), Special Black 550 (pH 2.8, volatiles 2.5%), Special Black 6 (pH 2.5, volatiles 18.0%), Color Black FW200 (pH 2.5, volatiles 20.0%), Color Black FW2 (pH 2.5, volatiles 16.5%), Color Black FW2V (pH 2.5, volatiles 16.5%); and products of Cabot Corp. such as Monarch 1000 (pH 2.5, volatiles 9.5%), Monarch 1300 (pH 2.5, volatiles 9.5%), Monarch 1400 (pH 2.5, volatiles 9.0%), Mogul-L (pH 2.5, volatiles 5.0%), and Regal 400R (pH 4.0, volatiles 3.5%).

Such oxidation processed carbon black thus obtained is less susceptible to an influence of oxidation which is caused by a locally excessive current under repeated voltage applications. Also the oxygen-containing functional group present on the surface increases the dispersibility into the polyimide resin to reduce a fluctuation in resistance and a dependence on the electric field, thereby decreasing an electric field concentration by the transfer voltage.

As a result, there can be obtained an intermediate transfer member capable of preventing a resistance decrease caused by the transfer voltage, improving the uniformity of electrical resistance, showing a reduced dependence on the electric field, also showing a reduced environmental change in the resistance, and providing a high image quality with reduced image defects such as a white streak on image in a sheet running portion. In case at least two kinds of the oxidation-processed carbon black are included, such oxidation-processed carbon blacks are preferably different substantially in the electroconductivity, and those different in physical properties such as a level of oxidation process, a DBP oil absorption or a BET specific surface area based on nitrogen adsorption.

In case of adding two or more carbon blacks different in the physical properties, it is possible, for example, to at first add a carbon black providing a high conductivity and then to add a carbon black providing a low conductivity, thereby regulating the surface resistance or the like.

Specific examples of the oxidation-processed carbon black include Special Black 4 (manufactured by Degussa AC, pH 3.0, volatiles 14.0%) and Special Black 250 (manufactured by Degussa AG, pH 3.1, volatiles 2.0%). A content of such oxidation-processed carbon black is preferably 10 to 50 weight %, more preferably 12 to 30 weight % with respect to the polyimide resin. A content less than 10 weight % may deteriorate the uniformity of the electrical resistance, thereby resulting in a large loss in the surface resistivity in a long-term use, while, at a content exceeding 50 weight %, a desired resistance may be difficult to obtain and a molded product may become undesirably brittle.

An intermediate transfer member of a polyimide resin in which an oxidation-processed carbon black is dispersed can be obtained by a step of preparing a polyamidic acid solution in which an oxidation-processed carbon black is dispersed, a step of forming a film (layer) on an internal peripheryl of a cylindrical mold, and a step of imidation.

For producing a polyamidic acid solution in which two or more types of the oxidation-processed carbon black are dispersed, there are conceived a method of dissolving and polymerizing the acid dianhydride component and the diamine component, in a dispersion liquid in which two or more types of the oxidation-processed carbon black are dispersed in advance in a solvent, and a method of dispersing two or more types of the oxidation-processed carbon black respectively in solvents thereby preparing two or more carbon black dispersion liquids, then dissolving and polymerizing the acid dianhydride component and the diamine component in each dispersion liquid, and mixing the polyamidic acid solutions, and such methods are suitably selected to obtain a polyamidic acid solution in which carbon black is dispersed.

The polyamidic acid solution thus obtained is supplied and developed on an internal periphery of a cylindrical mold to form a film, which is then heated to execute an imidation of the polyamidic acid. In such imidation heating step, an intermediate transfer member with satisfactory surface flatness can be obtained by executing an imidation under a beating condition of maintaining a constant temperature for 0.5 hours or longer. In the following, this process will be explained in detail.

At first a polyamidic acid solution is supplied onto an internal periphery of a cylindrical mold. Such supplying method can be suitable selected such as a supply by a dispenser or by a die. The surface of the internal periphery of the cylindrical mold employed in this step is preferably mirror-finished.

Then thus supplied polyamidic acid solution is formed into a film of a uniform thickness, for example by a centrifugal molding method under heating, a molding method with a bullet-like runner, or a rotation molding method. Subsequently there can be executed a process of heating the mold bearing the film on the internal periphery thereof in a dryer to a temperature causing imidation, or a process of eliminating the solvent until the film can sustain a belt shape, then peeling the film from the internal periphery of the mold and placing the film on an external periphery of a metal cylinder, and heating the film together with the metal cylinder thereby achieving imidation. In order to obtain an intermediate transfer member satisfactory in the flatness and the precision of the external surface, a method of eliminating the solvent until the film can sustain a belt shape, then re-placing the film on an external periphery of the metal cylinder, and executing imidation, is preferable.

A heating condition in the solvent eliminating step is not particularly restricted as long as the solvent can be eliminated, but is preferably 0.5 to 5 hours at 80 to 200° C. Then a molded substance, which can now sustain the form as a belt, is peeled off from the internal periphery of the mold. In this operation, a releasing treatment may be applied to the internal periphery of the mold.

Then the molded substance, which is heated and cured until it can sustain the form of a belt, is re-fitted on an external periphery of a metal cylinder and is heated together with such metal cylinder, thereby causing an imidation reaction of the polyamidic acid.

The metal cylinder to be employed in this step preferably has a linear expansion coefficient larger than that of polyimide resin and is given an external diameter somewhat smaller than the internal diameter of the polyimide molded substance, thereby achieving a thermal setting and obtaining a uniform endless belt of a uniform thickness. The metal cylinder to be employed in this step preferably has a surface roughness (Ra) on the external surface of 1.2 to 2.0 μm. In case the metal cylinder has a surface roughness (Ra) less than 1.2 μm on the external surface, the obtained belt-shaped intermediate transfer member may not cause a slippage by a shrinkage in the axial direction of the metal cylinder because the metal cylinder itself is excessively flat, whereby an extension may be generated in this step to result in a fluctuation in the film thickness and a deteriorated precision of the flatness.

On the other hand, in case the metal cylinder has a surface roughness (Ra) exceeding 2.0 μm on the external surface, the external surface pattern of the metal cylinder may be transferred onto the internal surface of the belt-shaped intermediate transfer member and may generate irregularities on the external surface thereof, thus inducing an image defect. A belt-shaped intermediate transfer member thus prepared of polyimide resin in which carbon black is dispersed has a surface roughness (Ra) of 1.5 μm or less on the external surface.

The surface roughness is measured according to JIS B601. A surface roughness (Ra) of the intermediate transfer member exceeding 1.5 μm may induce an image defect such as a noisy image. This is presumably because an electric field, caused by the voltage applied at the transfer step or by a peeling charging, is locally concentrated on a protruding portion of the belt to modify a surface of such portion, thereby generating a new conductive path with a lower resistance and inducing a lower image density, thus giving a noisy impression on the entire image.

The heating step for imidation is conducted preferably with a heating temperature of 220 to 280° C. and a heating time of 0.5 to 2 hours. The shrinkage at imidation becomes largest in the heating conditions of such range, though it is dependent also on the composition of the polyimide resin, thereby achieving a gradual shrinkage of the belt in the axial direction thereof, thus avoiding deteriorations in the fluctuation of the film thickness and the precision of flatness.

The intermediate transfer member after such heating step has a flatness of 5 mm or less, preferably 3 mm or less. A flatness of 5 mm or less causes no noises and little aberration among the colors. However, in case an edge portion of the belt is curled upward or downward, the belt with a flatness of 5 mm or less may occasionally leave a trace of contact with components in the vicinity, through such belt does not show breakage in the course of use. An intermediate transfer member with a flatness of 3 mm or less does not cause a contact with the components in the vicinity and scarcely shows aberration in the colors.

(Process Cartridge)

In the following there will be explained a process cartridge incorporating an electrophotographic photoreceptor of the invention.

Figure 5:
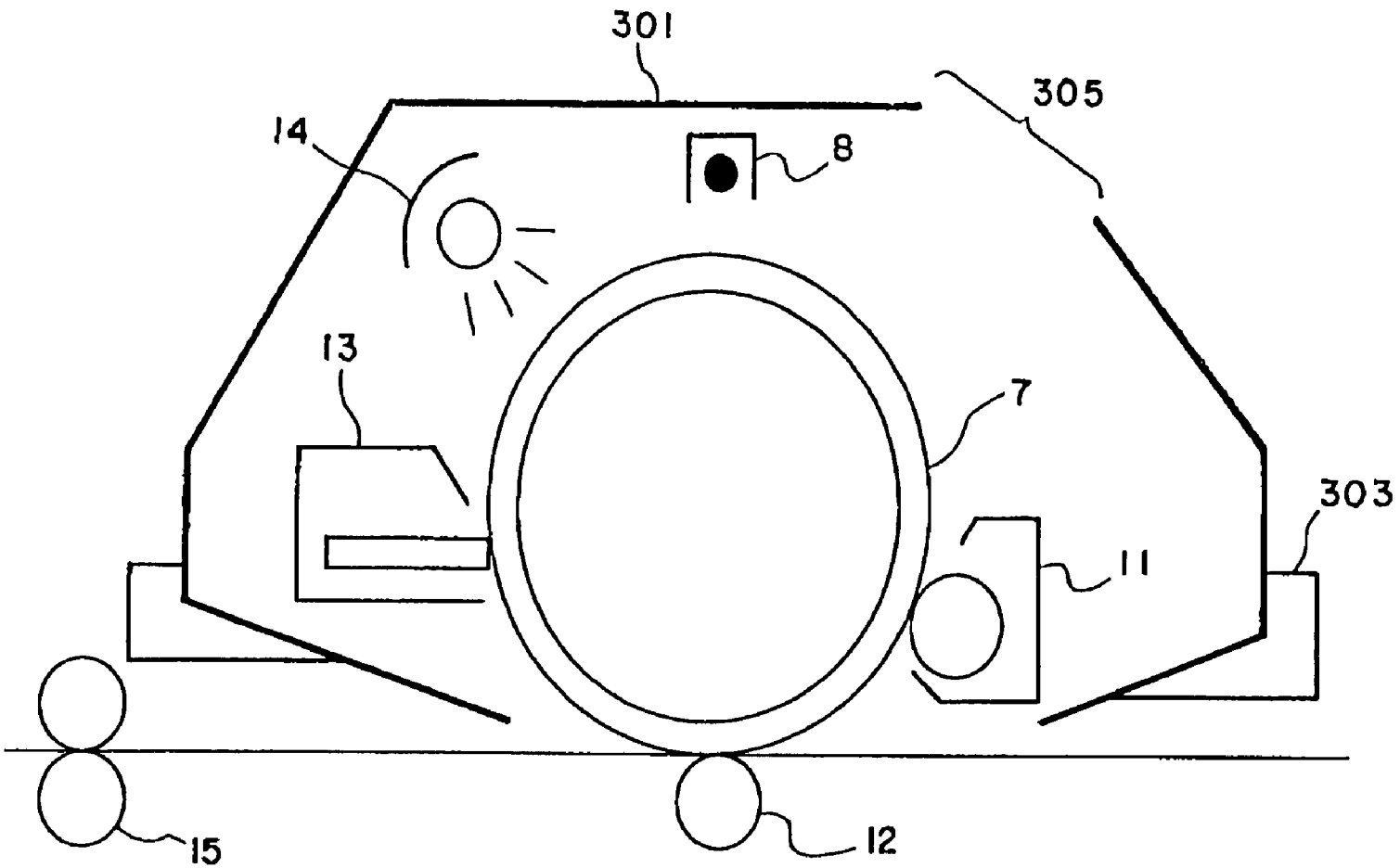
FIG. 5 is a schematic view illustrating a favorable embodiment of the process cartridge according to the invention.

FIG. 5 is a schematic view showing a preferred embodiment of the process cartridge of the invention.

A process cartridge 300 incorporates, within a case 301, an electrophotographic photoreceptor 7, a charging apparatus 8, a developing apparatus 11, a cleaning apparatus 13 and a charge eliminator 14 which are combined and integrated with a rail 303. The process cartridge 300 is not equipped with an exposure apparatus, but has an aperture 305 for exposure in the case 301. The electrophotographic photoreceptor 7 is an aforementioned electrophotographic photoreceptor of the invention, having at least an undercoat layer and a photosensitive layer on a conductive substrate in which the undercoat layer contains metal oxide particles to which an electron acceptor compound is attached.

Such process cartridge 300 is detachably mounted on a main body of an electrophotographic apparatus including a transfer apparatus 12, a fixing apparatus 15 and unillustrated other components, and constitutes an electrophotographic apparatus in cooperation with such main body.

EXAMPLE

Hereinafter, the invention will be described in detail with reference to EXAMPLEs, but it should be understood that the invention is not restricted by these EXAMPLEs.

Example 1

A mixture of 100 parts by weight of zinc oxide (manufactured by Tayca Corporation, average particle diameter 70 nm, specific surface area: 15 $m^2/g$) and 500 part by weight of tetrahydrofuran is stirred; 1.25 parts by weight of a silane coupling agent (KBM603: manufactured by Shin-Etsu Chemical) is added thereto; and the mixture is stirred for 2 hours. Then, tetrahydrofuran is evaporated under reduced pressure; and the residue is baked at 120° C. for 3 hours, to give a zinc oxide pigment with the surface thereof treated with the silane-coupling agent.

A mixture of 38 parts by weight of a solution of 60 parts by weight of the surface-treated zinc oxide pigment, 0.6 part by weight of alizarin, 13.5 parts by weight of a hardening agent of a blocked isocyanate (Sumidur 3173: manufactured by Sumitomo Bayer Urethane Co.), and 15 parts by weight of a butyral resin (BM-1: manufactured by Sekisui Chemical Co.) in 85 parts by weight of methylethylketone and 25 parts by weight of methylethylketone is dispersed in a sand mill using 1-mmϕ glass beads for 2 hours, to give a dispersion. To the dispersion thus obtained, 0.005 part by weight of a catalyst of dioctyltin dilaurate and 4.0 parts by weight of silicone resin particles (TOSPEARL 145): manufactured by GE Toshiba Silicones) are added, to give an undercoat layer coating solution. The coating solution is applied on an aluminum base material by dip coating method and dried and hardened at 170° C. for 40 min, to give an undercoat layer having a thickness of 25 μm.

Then, a photosensitive layer is formed over the undercoat layer. First, a mixture of 15 parts by weight of an charge-generating substance of hydroxygallium phthalocyanine having diffraction peaks at least at Bragg angles (2θ±0.2°) of 7.3°, 16.0°, 24.9°, and 28.0°, as determined by an X-ray diffraction spectrum obtained by using a Cukα ray, 10 part by weight of a binder resin of a vinyl chloride-vinyl acetate copolymer resin (VMCH, manufactured by Nippon Unicar Co., Ltd.), and 200 parts by weight of n-butyl acetate is dispersed in a sand mill using 1-mmϕ glass beads for 4 hours. To the dispersion obtained are added 175 parts by weight of n-butyl acetate and 180 parts by weight of methylethylketone, and the mixture is stirred, to give a coating solution for charge-generating layer. The coating solution for charge-generating layer is applied over the undercoat layer by dip coating and dried at room temperature, to give a charge-generating layer 31 having a thickness of 0.2 μm.

Subsequently, 1 part by weight of ethylene tetrafluoride resin particles, 0.02 part by weight of a fluorine-based graft polymer, 5 parts by weight of tetrahydrofuran, and 2 parts by weight of toluene are mixed well, to give an ethylene tetrafluoride resin particle suspension. Then, 4 parts by weight of an charge-transporting substance of N,N'-diphenyl-N,N'-bis(3-methylphenyl)-[1,1']-biphenyl-4,4'-diamine and 6 parts by weight of a bisphenol Z-type polycarbonate resin (viscosity average molecular weight: 40,000) are mixed and dissolved in 23 parts by weight of tetrahydrofuran and 10 part by weight of toluene; the ethylene tetrafluoride resin particle suspension above is added thereto; the mixture is stirred; and the mixture is dispersed repeatedly six times at a pressure up to 400 $kgf/cm^2$ ($3.92\times10^{-1}$ Pa) by using a high-pressure homogenizer (trade name: LA-33S, manufactured by Nanomizer Co., Ltd.) equipped with a penetration chamber having narrow flow channels, to give an ethylene tetrafluoride resin particle dispersion. Further, 0.2 part by weight of 2,6-di-t-butyl-4-methylphenol is added thereto, and the mixture is stirred, to give a coating solution for charge-transporting layer. The coating solution is applied over the charge-generating layer 31, dried at 115° C. for 40 minutes forming a charge-transporting layer having a thickness of 32 μm, to give an electrophotographic photoreceptor.

The electrophotographic photoreceptor thus obtained is loaded in a full-collar printer DocuCentre Color C400 manufactured by Fuji Xerox Co., Ltd., having a contact-type electrostatic charging device and an intermediate transfer device; the quality of printed images at the start and after continuous printing of 10,000 sheets are evaluated under a high-temperature and high-humidity condition (28° C., 40% RH), demonstrating that the electrophotographic photoreceptor provides favorable-quality images without generation of ghosts, background fog, or black spots. In addition, there are no black spots generated by leak defect; thus the electrophotographic photoreceptor shows an excellent consistency during the test. Results are summarized in Table 11.

Examples 2 to 4

Electrophotographic photoreceptors are prepared in a similar manner to EXAMPLE 1, except that the metal oxide surface-treated with a silane coupling agent and the electron acceptor compound used in EXAMPLE 1 are replaced with the compounds shown in Table 1, and the performance thereof is evaluated. Results are summarized in Table 11.

Comparative Example 1

An electrophotographic photoreceptor is prepared in a similar manner to EXAMPLE 1, except that the electron acceptor compound of EXAMPLE 1 is not used, and the performance thereof is evaluated. Results are summarized in Table 11.

TABLE 11

| | | Printing test under a high-temperature and high-humidity condition | | | | | |
|---|---|---|---|---|---|---|---|
| | | Printing test at the start | | | Printing test after 10,000-sheet printing | | |
| | Electron acceptor compound | Abnormal density | Ghost | Background fog and black spot | Abnormal density | Ghost | Background fog and black spot |
| Example 1 | Alizarin | Not generated | Not generated | Not generated | Not generated | Not generated | Not generated |
| Example 2 | 1-Hydroxyanthraquinone | Not generated | Not generated | Not generated | Not generated | Not generated | Not generated |
| Example 3 | Purpurin | Not generated | Not generated | Not generated | Not generated | Not generated | Not generated |
| Example 4 | 2-Amino-3-hydroxyanthraquinone | Not generated | Not generated | Not generated | Not generated | Not generated | Not generated |
| Comparative Example 1 | — | Not generated | Generated | Not generated | Generated | Generated | Generated |

What is claimed is:

1. An electrophotographic photoreceptor comprising:

at least an undercoat layer having a thickness of 15 μm or more; and a photosensitive layer on a conductive substrate, wherein the undercoat layer comprises a binder resin and contains metal oxide fine particles and an electron acceptor compound having a group reactive with the metal oxide fine particles, wherein the electron acceptor compound is one or more compounds selected from the group consisting of 1 hydroxyanthraquinone, purpurin, and aminohydroxyanthraquinone compounds, and wherein the metal oxide fine particles are surface-treated with a coupling agent, and are selected from the group consisting of titanium oxide, zinc oxide, tin oxide, and zirconium oxide, and wherein the electrophotographic photoreceptor comprises fluorinated resin particles in an outermost layer of the electrophotographic photoreceptor.

2. The electrophotographic photoreceptor according to claim 1, wherein the group reactive with the metal oxide fine particles of the electron acceptor compound is a hydroxyl group.

3. The electrophotographic photoreceptor according to claim 1, wherein the metal oxide fine particles are surface-treated with a silane coupling agent.

4. The electrophotographic photoreceptor according to claim 3, wherein the silane-coupling agent is a silane-coupling agent containing an amino group.

5. The electrophotographic photoreceptor according to claim 1, wherein the metal oxide fine particles have a specific surface area of 10 $m^2/g$ or more.

6. The electrophotographic photoreceptor according to claim 1, wherein the binder resin contains one or more resins selected from the group consisting of phenol resins, phenol-formaldehyde resins, melamine resins, urethane resins, and epoxy resins.

7. The electrophotographic photoreceptor according to claim 1, wherein the photosensitive layer further comprises a charge-generating layer and the charge-generating layer contains at least a phthalocyanine pigment or an azo pigment.

8. The electrophotographic photoreceptor according to claim 7, wherein the phthalocyanine pigment is a pigment selected from the group consisting of hydroxygallium phthalocyanine pigments, chlorogallium phthalocyanine pigments, hydroxytitanyl phthalocyanine pigments, and non-metal phthalocyanine pigments.

9. The electrophotographic photoreceptor according to claim 1, wherein the fluorinated resin particles are resins selected from the group consisting of ethylene tetrafluoride resins, ethylene trifluoride chloride resins, propylene hexafluoride resins, vinyl fluoride resins, vinylidene fluoride resins, ethylene difluoride dichloride resins and copolymers thereof.

10. A process cartridge comprising:

an electrophotographic photoreceptor comprising at least an undercoat layer having a thickness of 15 μm or more and a photosensitive layer formed on a conductive substrate, wherein the undercoat layer comprises a binder resin and contains metal oxide fine particles and an electron acceptor compound having a group reactive with the metal oxide fine particles; and at least one device selected from an electrostatic charging device, a developing device, a cleaning device, or a static charge eliminator, wherein the process cartridge is detachable from a main electrophotographic apparatus, wherein the electron acceptor compound is one or more compounds selected from the group consisting of 1 hydroxyanthraquinone, purpurin, and aminohydroxyanthraquinone compounds, and wherein the metal oxide fine particles are surface-treated with a coupling agent, and are selected from the group consisting of titanium oxide, zinc oxide, tin oxide, and zirconium oxide, and wherein the electrophotographic photoreceptor comprises fluorinated resin particles in an outermost layer of the electrophotographic photoreceptor.

11. A electrophotographic apparatus comprising:

an electrophotographic photoreceptor comprising at least an undercoat layer having a thickness of 15 μm or more and a photosensitive layer formed on a conductive substrate, wherein the undercoat layer comprises a binder resin and contains metal oxide fine particles and an electron acceptor compound having a group reactive with the metal oxide fine particles, wherein the electron acceptor compound is one or more compounds selected from the group consisting of 1-hydroxyanthraquinone, purpurin, and aminohydroxyanthraquinone compounds, and wherein the metal oxide fine particles are surface-treated with a coupling agent, and are selected from the group consisting of titanium oxide, zinc oxide, tin oxide, and zirconium oxide, and wherein the electrophotographic photoreceptor comprises fluorinated resin particles in an outermost layer of the electrophotographic photoreceptor.

12. The electrophotographic apparatus according to claim 11, further comprising a contact-process electrostatic charging device that charges the photoreceptor being in contact therewith.

13. The electrophotographic apparatus according to claim 11, further comprising an intermediate transfer device that receives an image formed on the electrophotographic photoreceptor.

14. The electrophotographic photoreceptor according to claim 1, wherein the metal oxide fine particles have a powder resistance of approximately $10^2$ to $10^{11}$ Ωcm.

15. The process cartridge according to claim 10, wherein the metal oxide fine particles have a powder resistance of approximately $10^2$ to $10^{11}$ Ωcm.

16. The electrophotographic apparatus according to claim 11, wherein the metal oxide fine particles have a powder resistance of approximately $10^2$ to $10^{11}$ Ωcm.

* * * * *